US006917865B2

(12) United States Patent
Arai et al.

(10) Patent No.: US 6,917,865 B2
(45) Date of Patent: Jul. 12, 2005

(54) ENGINE OIL, DEGRADATION-DETERMINING SYSTEM AND METHOD, AND ENGINE CONTROL UNIT

(75) Inventors: Takashi Arai, Saitama-ken (JP); Hiroshi Hashimoto, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/692,000

(22) Filed: Oct. 24, 2003

(65) Prior Publication Data

US 2004/0093150 A1 May 13, 2004

(30) Foreign Application Priority Data

Oct. 31, 2002 (JP) ..... 2002-317906

(51) Int. Cl.[7] ..... G06F 19/00
(52) U.S. Cl. ..... 701/30; 701/29; 340/450.3
(58) Field of Search ..... 701/29, 30, 33; 340/438, 450, 450.3, 457, 457.3, 459, 460

(56) References Cited

U.S. PATENT DOCUMENTS 4,503,419 A * 3/1985 Kidd et al. ..... 340/450.3
4,706,193 A * 11/1987 Imajo et al. ..... 701/30
5,006,829 A * 4/1991 Miyamoto et al. ..... 340/459
6,463,967 B1 * 10/2002 Boyle ..... 141/94

* cited by examiner

*Primary Examiner*—Gary Chin
(74) *Attorney, Agent, or Firm*—Arent Fox PLLC

(57) ABSTRACT

There is provided an engine oil degradation-determining system which is capable of accurately detecting whether or not engine oil has been replenished, to thereby enhance accuracy of determination as to a degradation level of engine oil in use, at a low cost. A crankshaft angle sensor detects the engine rotational speed of an internal combustion engine. An ECU calculates a cumulative revolution number indicative of a degradation level of engine oil. An oil level sensor detects an oil level of the engine oil. When the detected oil level, which was equal to or lower than a predetermined lower limit level before stoppage of the engine, is equal to or higher than a predetermined higher limit level after start operation following the stoppage, the calculated cumulative revolution number is corrected in the direction of indicating a lower degradation level.

15 Claims, 15 Drawing Sheets

ENGINE OIL, DEGRADATION-DETERMINING SYSTEM AND METHOD, AND ENGINE CONTROL UNIT

BACKGROUND OF THE INVENTION

1. Field of the Invention

The present invention relates to an engine oil degradation-determining system and method, and an engine control unit, for determining a degradation level of engine oil for lubricating an internal combustion engine.

2. Description of the Related Art

Conventionally, an engine oil degradation-determining system of the above-mentioned kind has been proposed e.g. in Japanese Laid-Open Patent Publication (Kokai) No. 62-203915 (this system will be hereinafter referred to as "the first degradation-determining system"). The first degradation-determining system, which determines degradation of engine oil used in an engine for a vehicle, includes an oil temperature sensor for detecting the temperature of the engine oil, an engine rotational speed sensor for detecting the rotational speed of the engine, a control unit for calculating the service life of the engine oil, and a display for displaying the calculated service life of the engine oil.

In the first degradation-determining system, a degradation coefficient of the engine oil is set e.g. according to the detected oil temperature and engine rotational speed, and the travel distance of the vehicle, and then a numerical value indicative of the effective engine oil usage is calculated based on the degradation coefficient. Further, the calculated numerical value is subtracted from a value indicative of the effective service life of the engine oil (hereinafter referred to as "the effective service life value") to thereby obtain a numerical value indicative of the remaining life of the engine oil (hereinafter referred to as "the remaining life value"). The calculated remaining life value is displayed on the display, as a proportion to the effective service life value, so as to notify the driver. Further, when the remaining life value becomes smaller than a predetermined value, a warning to the effect that an oil change is needed is displayed on the display. Then, when a manual reset switch is operated after execution of the oil change, the travel distance of the vehicle, the engine rotational speed, and so forth are reset to respective predetermined values.

Another conventional engine oil degradation-determining system has been proposed e.g. in Japanese Laid-Open Patent Publication (Kokai) No. 62-55407 (this system will be hereinafter referred to as "the second degradation-determining system"). The second degradation-determining system, which also determines degradation of engine oil used in an engine for a vehicle, includes a level sensor switched on and off depending on whether or not the oil level of the engine oil becomes lower than a predetermined limit level, an engine hood switch for detecting opening and closing of an engine hood for replenishment of the engine oil, and an arithmetic operation circuit for calculating a time to change the engine oil. In the second degradation-determining system, when it is detected that the level sensor has been switched on in a state in which an ignition switch has been turned off and the engine hood is open, it is judged that a predetermined sufficient amount of engine oil has been replenished, and the time to change the engine oil is prolonged.

In the above first degradation-determining system, however, the engine rotational speed and the travel distance of the vehicle as parameters used in calculating the effective engine oil usage are reset only when the manual reset switch is operated after an oil change. For this reason, when a driver forgets to operate the reset switch, the fact that the remaining life of the engine oil is extended by the oil change is not reflected in the calculation of the remaining life, and hence the remaining life value is erroneously calculated. As a result, an unnecessary warning for an oil change can be displayed.

On the other hand, in the second conventional degradation-determining system, in the state in which the ignition switch has been turned off and the engine hood is open, even when the oil level rises for a reason other than replenishment of the oil engine, the level sensor can be switched on. As a result, it is erroneously judged that engine oil has been replenished, and hence the time to change the engine oil is erroneously prolonged. Particularly when the oil level is close to the lower limit level, even a slight change in the oil level turns off the switch of the sensor, which makes the above problem more serious.

This problem can be solved by accurate detection of the oil level. However, to detect the oil level accurately, it is necessary to use an oil level sensor for detecting the oil level linearly, and further in combination with the oil level sensor, a vehicle inclination sensor for detecting an inclination of the vehicle, so as to compensate for the influence of an inclination of the vehicle on a result of the detection by the oil level sensor. These sensors are expensive, which results in an increase in manufacturing costs.

SUMMARY OF THE INVENTION

It is an object of the invention to provide an engine oil degradation-determining system and method, and an engine control unit, which are capable of accurately detecting whether or not engine oil has been replenished, to thereby enhance accuracy of determination as to a degradation level of engine oil in use, at a low cost.

To attain the above object, in a first aspect of the present invention, there is provided an engine oil degradation-determining system that determines a degradation level of engine oil for lubricating an internal combustion engine, the engine oil degradation-determining system comprising:

operating condition-detecting means for detecting an operating condition of the engine;

degradation level parameter-calculating means for calculating a degradation level parameter indicative of a degradation level of the engine oil, based on the detected operating condition;

degradation-determining means for determining the degradation level of the engine oil, based on the calculated degradation level parameter;

oil level-detecting means for detecting an oil level of the engine oil; and degradation level parameter-correcting means for correcting the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

With this arrangement of the engine oil degradation-determining system according to the first aspect of the invention, the degradation level parameter indicative of a degradation level of engine oil is calculated based on the detected operating condition of the internal combustion engine, and then the degradation level of the engine oil is determined based on the calculated degradation level parameter. Further, when an oil level of the engine oil detected by the oil level-detecting means was equal to or lower than a predetermined lower limit value before stoppage of the engine, and is equal to or higher than a predetermined upper limit value after start operation of the engine following the stoppage, it is judged that engine oil has been replenished during the stoppage, and the degradation level parameter is corrected in the direction of indicating a lower degradation level.

As described above, according to the first aspect of the present invention, it is determined whether or not engine oil has been replenished, under the condition that the oil level has sharply changed from a level equal to or lower than the lower limit value before stoppage of the engine to a level equal to or higher than the upper limit value after the start of the engine. Therefore, differently from the conventional degradation-determining system which performs the determination by setting a single lower limit as a reference for oil level determination, the present system is capable of accurately determining whether or not engine oil has been replenished, while positively preventing erroneous determination from being made based on a slight variation in the oil level. Consequently, the present system is capable of properly correcting the degradation level parameter in response to an actual replenishment of the engine oil, and hence properly calculating the degradation level based on the corrected degradation level parameter, thereby performing accurate determination as to the degradation level of the engine oil.

Further, in the present engine oil degradation-determining system, it is not necessary to operate a manual reset switch for correction of the degradation level parameter, as in the conventional first degradation-determining system, and hence the present system is free from errors caused by a driver forgetting to operate the reset switch in the conventional system, which make it possible to positively correct the degradation level parameter in response to a replenishment of the engine oil. Furthermore, since it suffices to detect that the oil level is equal to or lower than the predetermined lower limit value and that the oil level is equal to or higher than the predetermined upper limit value, expensive sensors, such as a linear oil level sensor and a vehicle inclination sensor, for accurate oil level detection can be dispensed with, which makes it possible to realize the degradation-determining system of the present invention at low costs.

Preferably, the oil level-detecting means comprises an upper limit switch for detecting whether or not the oil level is equal to or higher than the predetermined upper limit value, and a lower limit switch for detecting whether or not the oil level is equal to or lower than the predetermined lower limit value.

More preferably, the upper limit switch outputs an ON signal when the oil level is equal to or higher than the predetermined upper limit value, outputs an OFF signal when the oil level is equal to or lower than a second upper limit value lower than the predetermined upper limit value, and maintains the ON or OFF signal having been output before the oil level has entered a first range between the predetermined upper limit value and the second upper limit value when the oil level is in the first range, and the lower limit switch outputs an ON signal when the oil level is equal to or lower than the predetermined lower limit value, outputs an OFF signal when the oil level is equal to or higher than a second lower limit value higher than the predetermined lower limit value, and maintains the ON or OFF signal having been output before the oil level has entered a second range between the predetermined lower limit value and the second lower limit value when the oil level is in the second range.

With the arrangements of these preferred embodiments, the oil level-detecting means can be implemented by relatively simple and inexpensive ON/OFF-type switches which are turned on and off according to whether the oil level is equal to or higher than the upper limit value and whether the oil level is equal to or lower than the lower limit value, respectively.

Preferably, the degradation level parameter is a cumulative number of revolutions of the engine counted starting from a time of an oil change.

More preferably, the degradation level parameter-calculating means includes means for carrying out a limiting process on the cumulative number of revolutions based on a cumulative travel distance of a vehicle on which the engine is installed, measured starting from the oil change.

To attain the above object, in a second aspect of the present invention, there is provided an engine oil degradation-determining method of determining a degradation level of engine oil for lubricating an internal combustion engine, the engine oil degradation-determining method comprising the steps of:

detecting an operating condition of the engine;

calculating a degradation level parameter indicative of a degradation level of the engine oil, based on the detected operating condition;

determining the degradation level of the engine oil, based on the calculated degradation level parameter;

detecting an oil level of the engine oil; and correcting the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

With the arrangement of the engine oil degradation-determining method according to the second aspect of the invention, it is possible to obtain the same advantageous effects as provided by the first aspect of the present invention.

Preferably, the step of detecting an oil level includes detecting the oil level using an upper limit switch for detecting whether or not the oil level is equal to or higher than the predetermined upper limit value, and a lower limit switch for detecting whether or not the oil level is equal to or lower than the predetermined lower limit value.

More preferably, the upper limit switch and the lower limit switch operate as described in the corresponding preferred embodiment of the first aspect of the invention.

With the arrangements of these preferred embodiments, it is possible to obtain the same advantageous effects as provided by the corresponding preferred embodiments of the first aspect of the present invention.

Preferably, the degradation level parameter is a cumulative number of revolutions of the engine counted starting from a time of an oil change.

More preferably, the step of calculating a degradation level parameter includes carrying out a limiting process on the cumulative number of revolutions based on a cumulative travel distance of a vehicle on which the engine is installed, measured starting from the oil change.

To attain the above object, in a third aspect of the present invention, there is provided an engine control unit including a control program for causing a computer to determine a degradation level of engine oil for lubricating an internal combustion engine, wherein the program causes the computer to detect an operating condition of the engine, calculate a degradation level parameter indicative of a degradation level of the engine oil, based on the detected operating condition, determine the degradation level of the engine oil, based on the calculated degradation level parameter, detect an oil level of the engine oil, and correct the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

With the arrangement of the engine oil degradation-determining method according to the third aspect of the invention, it is possible to obtain the same advantageous effects as provided by the first aspect of the present invention.

Preferably, when the control program causes the computer to detect an oil level, the control program causes the computer to detect the oil level using an output from an upper limit switch for detecting whether or not the oil level is equal to or higher than the predetermined upper limit value, and an output from a lower limit switch for detecting whether or not the oil level is equal to or lower than the predetermined lower limit value.

More preferably, the upper limit switch and the lower limit switch operate as described in the corresponding preferred embodiment of the first aspect of the invention.

With the arrangements of these preferred embodiments, it is possible to obtain the same advantageous effects as provided by the corresponding preferred embodiments of the first aspect of the present invention.

Preferably, the degradation level parameter is a cumulative number of revolutions of the engine counted starting from a time of an oil change.

More preferably, when the control program causes the compute to calculate the degradation level parameter, the control program causes the computer to carry out a limiting process on the cumulative number of revolutions based on a cumulative travel distance of a vehicle on which the engine is installed, measured starting from the oil change.

The above and other objects, features, and advantages of the invention will become more apparent from the following detailed description taken in conjunction with the accompanying drawings.

DETAILED DESCRIPTION OF PREFERRED EMBODIMENTS

Figure 1:
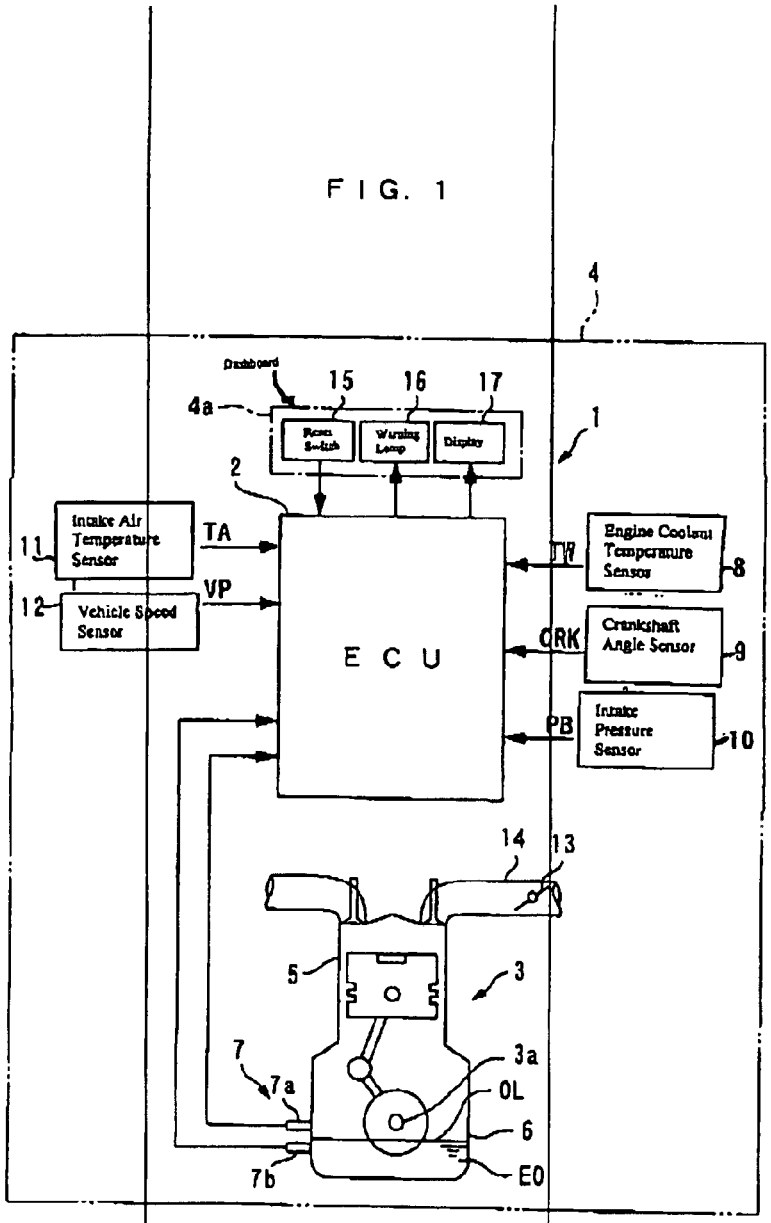
FIG. 1 is a block diagram schematically showing the arrangement of an engine oil degradation-determining system to which the present invention is applied, and an internal combustion engine using the engine oil degradation-determining system.

The invention will now be described in detail with reference to the drawings showing an embodiment thereof. FIG. 1 schematically shows the arrangement of an engine oil degradation-determining system (hereinafter simply referred to as "the degradation-determining system") to which the present invention is applied and an internal combustion engine using the degradation-determining system. As shown in FIG. 1, the degradation-determining system 1 includes an ECU 2, which executes a control process, described in detail hereinafter, according to operating conditions of the internal combustion engine (hereinafter simply referred to as "the engine") 3.

The engine 3 is a four-cylinder gasoline engine installed on a vehicle 4. A cylinder block 5 of the engine 3 has a lower portion thereof formed as an oil pan 6 for storing engine oil EO. The engine oil EO is supplied, during operation of the engine 3, to components of the engine 3 by an oil pump (not shown) driven by the engine 3, for lubrication and cooling of the component parts. Further, the engine oil EO supplied to the component parts of the engine 3 is returned to the oil pan 6 via a return passage (not shown), for circulation within the engine 3.

Figure 2:
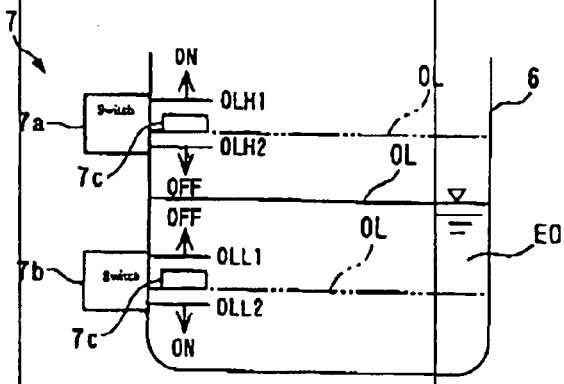
FIG. 2 is a view schematically showing the construction of an oil level sensor, which is useful in explaining operation of the same.

An oil level sensor 7 (oil level-detecting means) is inserted into the oil pan 6, for detecting an oil level OL of the engine oil EO. The oil level sensor 7 is comprised of an upper limit switch 7*a* and a lower limit switch 7*b*. As shown in FIG. 2, each of the switches 7*a* and 7*b* is a float type which is provided with a float 7*c*. The upper limit switch 7*a* outputs an ON signal when the oil level OL is equal to or higher than a predetermined first upper limit level OLH1 (upper limit value), and outputs an OFF signal when the oil level OL is lower than a second upper limit level OLH2 lower than the first upper limit level OLH1. A range between the first and second upper limit levels OLH1, OLH2 is set to a dead zone where the ON or OFF signal having been output before the oil level OL enters the dead zone is maintained. Similarly, the lower limit switch 7*b* outputs an OFF signal when the oil level OL is equal to or higher than a predetermined first lower limit level OLL1 lower than the second upper limit level OLH2, and outputs an ON signal when the oil level OL is lower than a second lower limit level OLL2 (lower limit value) lower than the first lower limit level OLL1. A range between the first and second lower limit levels OLL1, OLL2 is set to a dead zone. The ON/OFF signals from the upper and lower limit switches 7*a*, 7*b* are delivered to the ECU 2.

An engine coolant temperature sensor 8 is mounted in the cylinder block 5 of the engine 3. The engine coolant temperature sensor 8 senses a temperature TW of an engine coolant circulating through the cylinder block 5 of the engine 3 (hereinafter referred to as "the engine coolant temperature TW"), and outputs an electric signal indicative of the sensed engine coolant temperature TW to the ECU 2. Further, a crankshaft angle sensor 9 (operating condition-detecting means) is disposed around a crankshaft 3*a* of the engine 3. The crankshaft angle sensor 9 delivers a CRK signal whose pulse is generated whenever the crankshaft 3*a* rotates through a predetermined angle (e.g. 30 degrees) to the ECU 2. The ECU 2 calculates a rotational speed NE of the engine 3 (hereinafter referred to as "the engine rotational speed NE")(operating condition) based on the CRK signal.

Further, the ECU 2 receives an electric signal indicative of an absolute pressure PB within an intake pipe 14 (hereinafter referred to as "the intake pipe absolute pressure PB") from an intake pressure sensor 10 inserted into the intake pipe 14 at a location downstream of a throttle valve 13 of the engine 3, an electric signal indicative of a temperature TA of intake air (hereinafter referred to as "the intake air temperature TA") from an intake air temperature sensor 11, and an electric signal indicative of a speed VP of the vehicle 4 (hereinafter referred to as "the vehicle speed VP") from a vehicle speed sensor 12.

On a dashboard 4*a* of the vehicle 4, there are arranged a reset switch 15, a warning lamp 16, and a display 17. The reset switch 15 is operated e.g. by the driver after a change of the engine oil EO. The reset switch 15 which is normally held in an OFF state is turned on only when depressed, and a reset signal indicative of the fact is delivered to the ECU 2. The warning lamp 16 warns the driver that the engine oil EO should be changed, while the display 17 displays a remaining oil life value ROLF, referred to hereinafter, of the engine oil EO, and so forth. These operations are controlled by the ECU 2.

The ECU 2 functions, in the present embodiment, as the operating condition-detecting means, degradation level parameter-calculating means, degradation-determining determining means, and degradation level parameter-correcting means. The ECU 2 is implemented by a microcomputer comprised of an I/O interface, a CPU, a RAM, and a ROM. The signals from the aforementioned sensors 7 to 12 are input to the CPU after the I/O interface performs A/D conversion and waveform shaping thereon. Based on these input signals, in accordance with control programs read from the ROM, the CPU determines an operating condition of the engine 3 and a traveling condition of the vehicle 4, and based on the determinations, carries out the control process described hereinafter.

Figure 3:
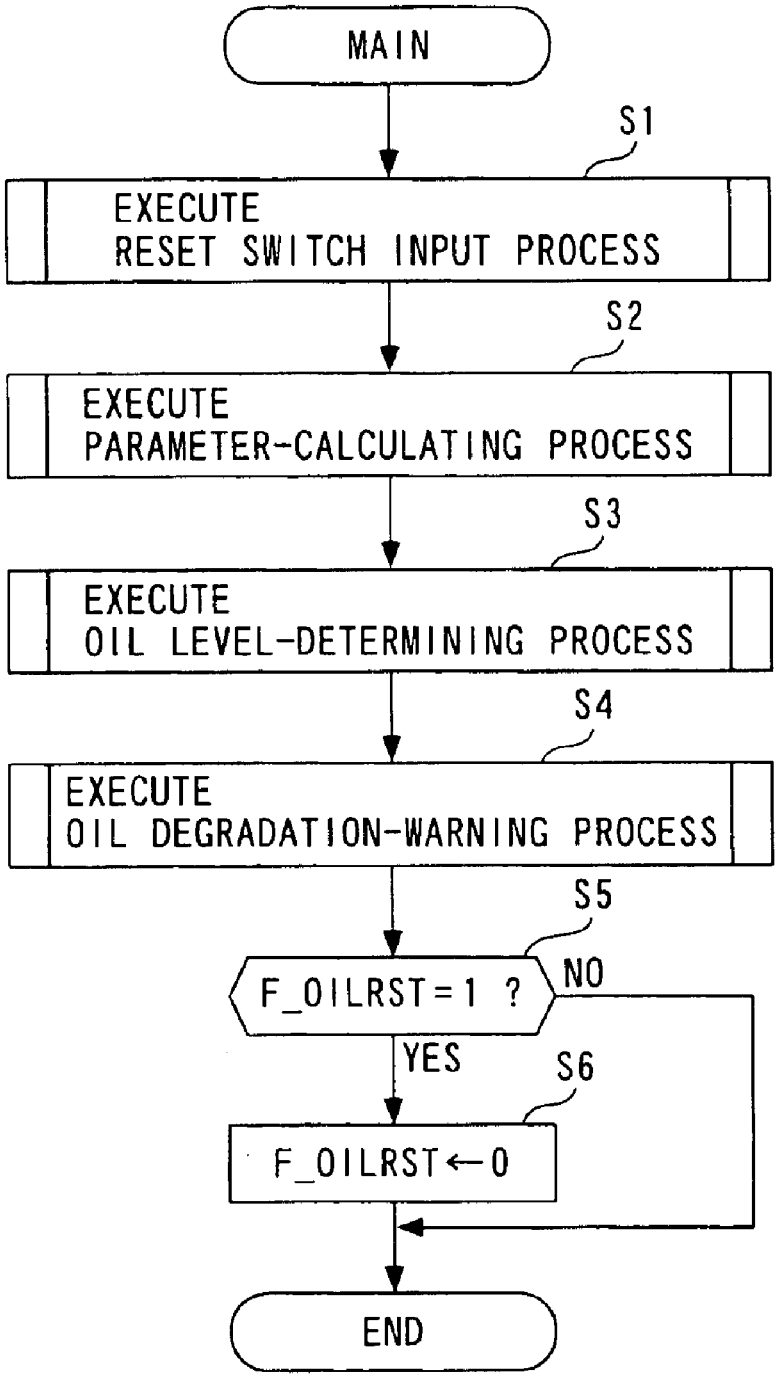
FIG. 3 is a flowchart showing a main flow of an engine oil degradation-determining process.

FIG. 3 shows a main flow of an engine oil degradation-determining process which is executed by the ECU 2. This process is carried out at intervals of a predetermined time period (e.g. one second). First, in a step 1 (in the figure, shown as "S1", which rule applies similarly in the following description), a reset switch input process is executed. In this process, the operating state of the reset switch 15 is monitored, and when the ON state of the reset switch 15 has continued over a predetermined time period, an oil change-determining flag F_OILRST is set to 1.

Then, a parameter-calculating process is carried out (step 2). This process is executed so as to calculate various parameters for use in an oil degradation-warning process which is executed in a step 4, described hereinafter.

Then, an oil level-determining process is carried out (step 3). This process is executed so as to determine whether or not the oil level OL is lowered, whether or not engine oil EO has been replenished, and so forth, based on results of detection by the oil level sensor 7.

Then, the oil degradation-warning process is carried out (step 4). In this process, the parameters calculated in the step 2 are stored according to the operating state of the reset switch 15 determined in the step 1, and the remaining oil life value ROLF indicative of the remaining life of the engine oil EO is calculated based on the stored parameters.

Then, in a step 5, it is determined whether or not the oil change-determining flag F_OILRST is set to 1. If the answer to the question is negative (NO), i.e. if the oil change-determining flag F_OILRST has not been set to 1 in the step 1, the engine oil degradation-determining process is immediately terminated. On the other hand, if the answer to the question of the step 5 is affirmative (YES), the oil change-determining flag F_OILRST is set to 0 (step 6), followed by terminating the engine oil degradation-determining process.

In the following, subroutines for carrying out the processes executed in the respective steps 1 to 4 are described in the mentioned order.

Figure 4:
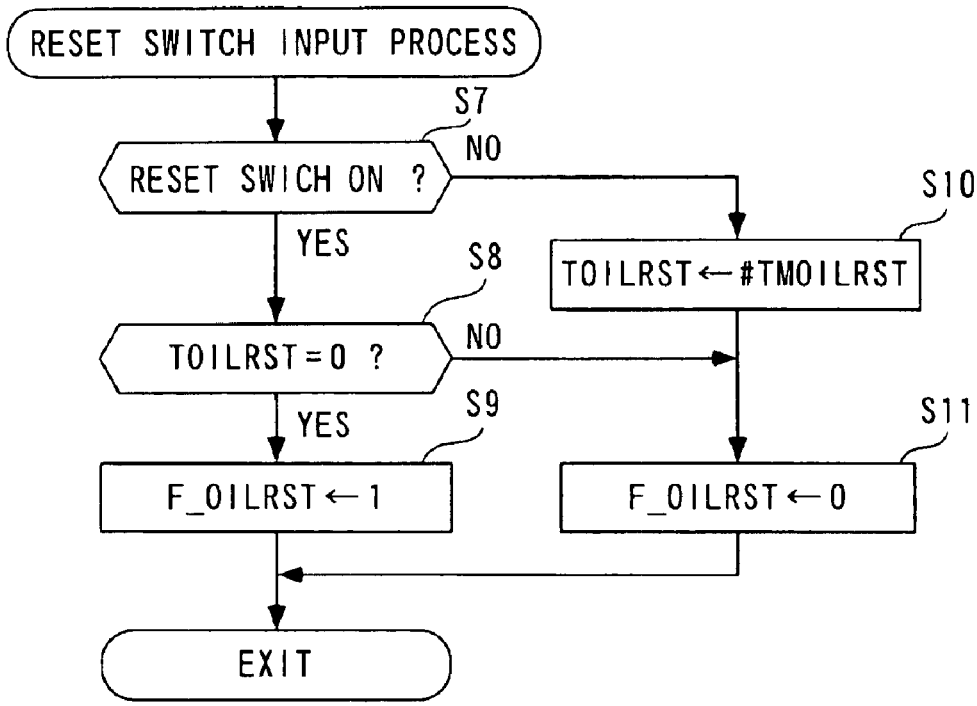
FIG. 4 is a flowchart of a subroutine for carrying out a reset switch input process.

FIG. 4 shows the subroutine for carrying out the reset switch input process executed in the step 1. In the present process, first in a step 7, it is determined whether or not the reset switch 15 is ON. If the answer to the question is negative (NO), i.e. if the reset switch 15 is OFF, a down-count reset timer TOILRST is set to a predetermined time period #TMOILRST (e.g. 10 seconds) (step 10). Then, it is judged that the engine oil EO has not been changed, and the oil change-determining flag F_OILRST is set to 0 (step 11), followed by terminating the present process.

On the other hand, if the answer to the question of the step 7 is affirmative (YES), i.e. if the reset switch 15 is ON, it is determined whether or not the count of the reset timer TOILRST set in the step 10 is equal to 0 (step 8). If the answer to this question is negative (NO), i.e. if the ON state of the reset switch 15 has not continued over the predetermined time period #TMOILRST, the step 11 is executed to maintain the oil change-determining flag F_OILRST at 0, followed by terminating the present process.

If the answer to the question of the step 8 is affirmative (YES), i.e. if the ON state of the reset switch 15 has continued over the predetermined time period #TMOILRST, it is judged that the engine oil EO has been changed, and the oil change-determining flag F_OILRST is set to 1 (step 9), followed by terminating the present process. Thus, by waiting for the ON state of the reset switch 15 to continue over the predetermined time period #TMOILRST, it is possible to avoid erroneously determining that an oil change has been performed, when the reset switch 15 is turned on by mistake. Further, the oil change-determining flag F_OILRST set to 1 in the step 9 is reset to 0 by execution of the step 6 in FIG. 3. This means that the oil change-determining flag F_OILRST is set to 1 only once when the answer to the question of the step 9 becomes affirmative (YES) immediately after execution of an oil change.

Figure 5:
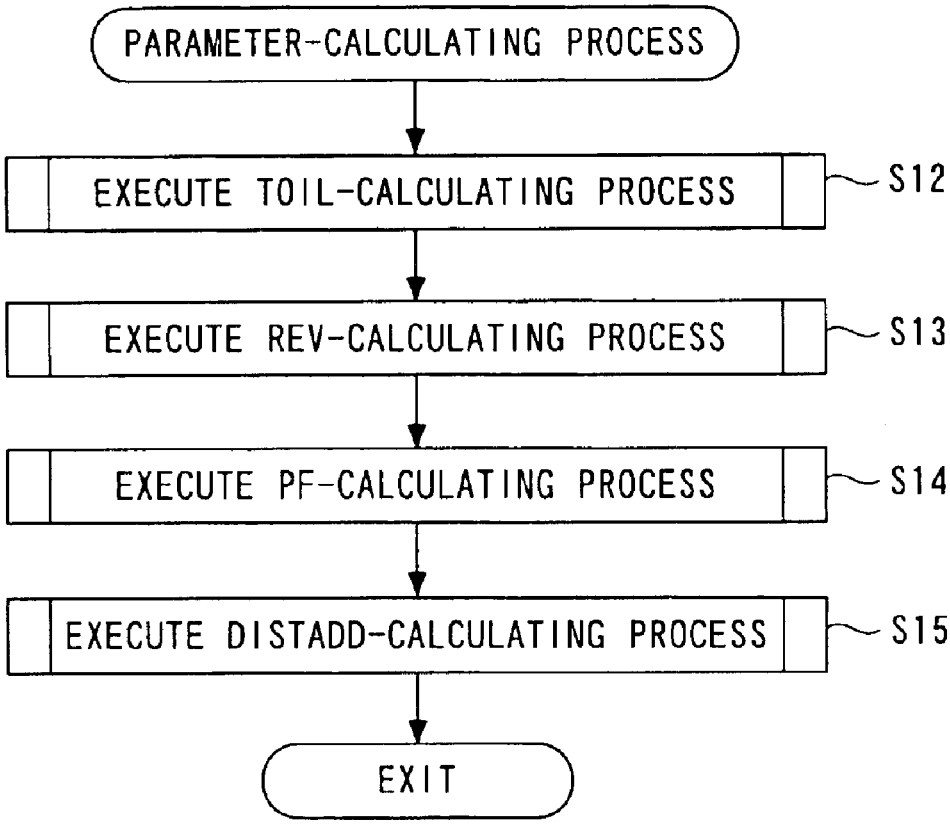
FIG. 5 is a flowchart of a subroutine for carrying out a parameter-calculating process.

FIG. 5 shows the subroutine for carrying out the parameter-calculating process executed in the step 2 in FIG. 3. In this process, first in a step 12, a current temperature TOIL of the engine oil EO (hereinafter referred to as "the oil temperature TOIL") is calculated based on the detected engine coolant temperature TW, intake pipe absolute pressure PB, engine rotational speed NE, and intake air temperature TA. It should be noted that an oil temperature sensor (not shown) may be used to directly detect the oil temperature.

Then, a number of revolutions per second REV (hereinafter referred to as "the revolutions-per-second number REV") is calculated by conversion from the engine rotational speed NE indicative of a number of revolutions per minute (step 13). This revolutions-per-second number REV is used in a cumulative revolution number-calculating process, described in detail hereinafter.

Figure 6:
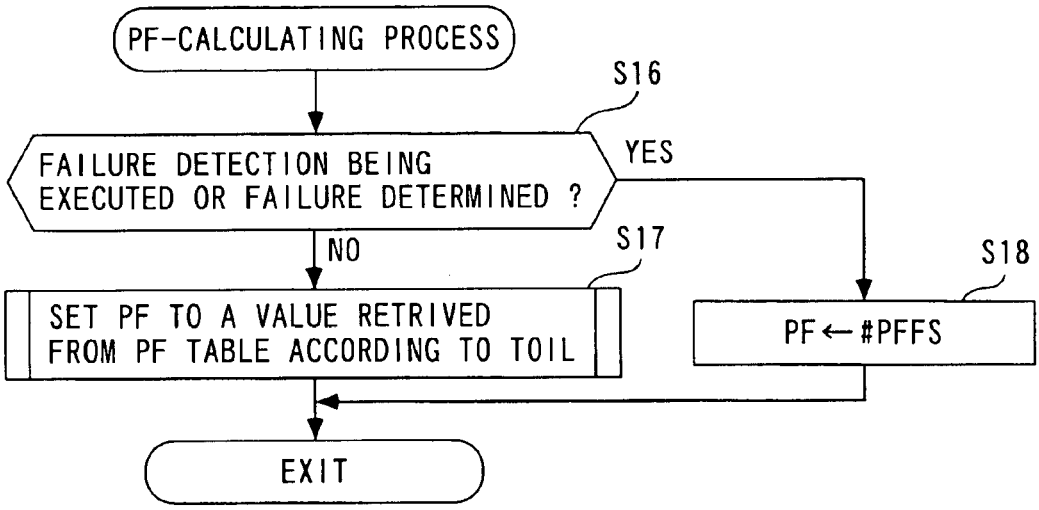
FIG. 6 is a flowchart of a subroutine for carrying out a degradation coefficient-calculating process.

Then, a degradation coefficient PF is calculated (step 14). The degradation coefficient PF is used to allow a degradation rate of the engine oil EO, which changes according to the oil temperature, to be reflected in the oil degradation-detecting process. FIG. 6 shows a routine of a process for calculating the degradation coefficient PF. In the degradation coefficient (PF)-calculating process, first in a step 16, it is determined whether or not failure detection for the sensors 8 to 11 necessary for calculation of the oil temperature TOIL is being carried out, or whether or not a failure of at least one of the sensors 8 to 11 has been detected. If the answer to the question is negative (NO), i.e. if the sensors 8 to 11 are all normal, the degradation coefficient PF is set by retrieval from a PF table according the calculated oil temperature TOIL (step 17).

Figure 7:
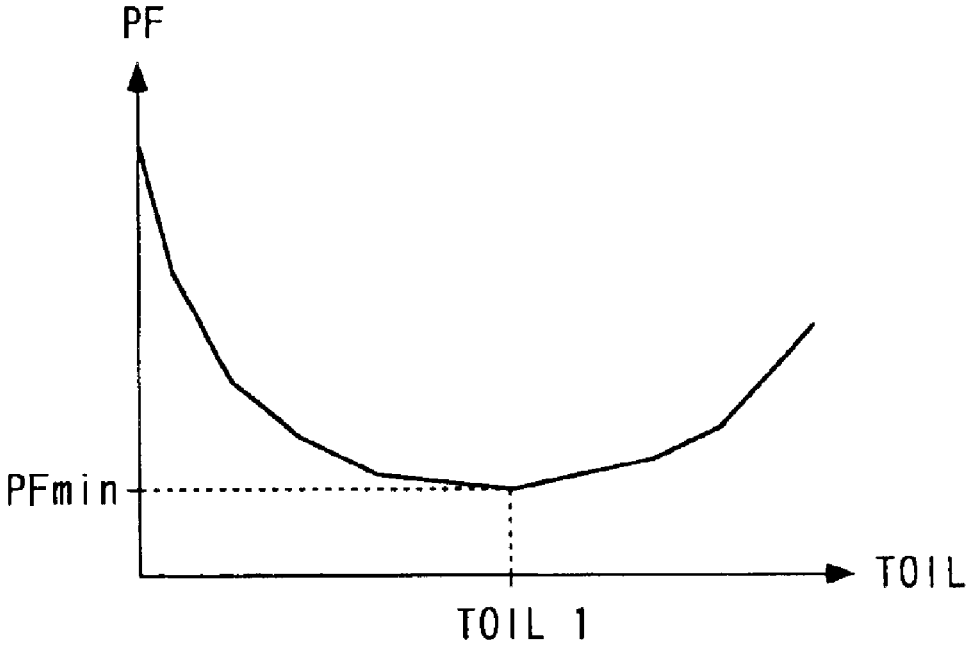
FIG. 7 is a diagram showing a table for use in calculating a degradation coefficient.

FIG. 7 shows an example of the PF table. When the oil temperature TOIL is equal to a predetermined temperature TOIL1 (e.g. 80° C.), it is considered that the influence of the oil temperature TOIL on degradation of the engine oil EO is minimum, and hence in the PF table, the degradation coefficient PF is set to a minimum value PFmin (e.g. 1.0). Further, the degradation coefficient PF is set such that as the oil temperature TOIL rises and falls from the predetermined temperature TOIL1, the degradation coefficient PF progressively increases at respective change rates similar to each other. The reason why the degradation coefficient PF is thus set is that as the oil temperature TOIL becomes higher or lower than the predetermined temperature TOIL1, the influence of the oil temperature TOIL on degradation of the engine oil EO progressively increases.

On the other hand, if the answer to the question of the step 16 is affirmative (YES), i.e. if the oil temperature TOIL cannot be properly calculated e.g. due to execution of failure detection for the sensors 8 to 11, the degradation coefficient PF is set to a predetermined value #PFFS (e.g. 1.0) for a failure time (step 18), followed by terminating the PF-calculating process.

Referring again to FIG. 5, in a step 15 following the step 14, a process for calculating a cumulative travel distance of the vehicle 4 is executed, followed by terminating the parameter-calculating process. This cumulative travel distance-calculating process is executed so as to calculate a current cumulative travel distance DISTADD of the vehicle 4. The cumulative travel distance DISTADD, which is reset to 0, as described in detail hereinafter, when the oil change-determining flag F_OILRST is set to 1 after a change of the engine oil EO, is indicative of a cumulative travel distance over which the vehicle 4 has traveled after the oil change.

Figure 8:
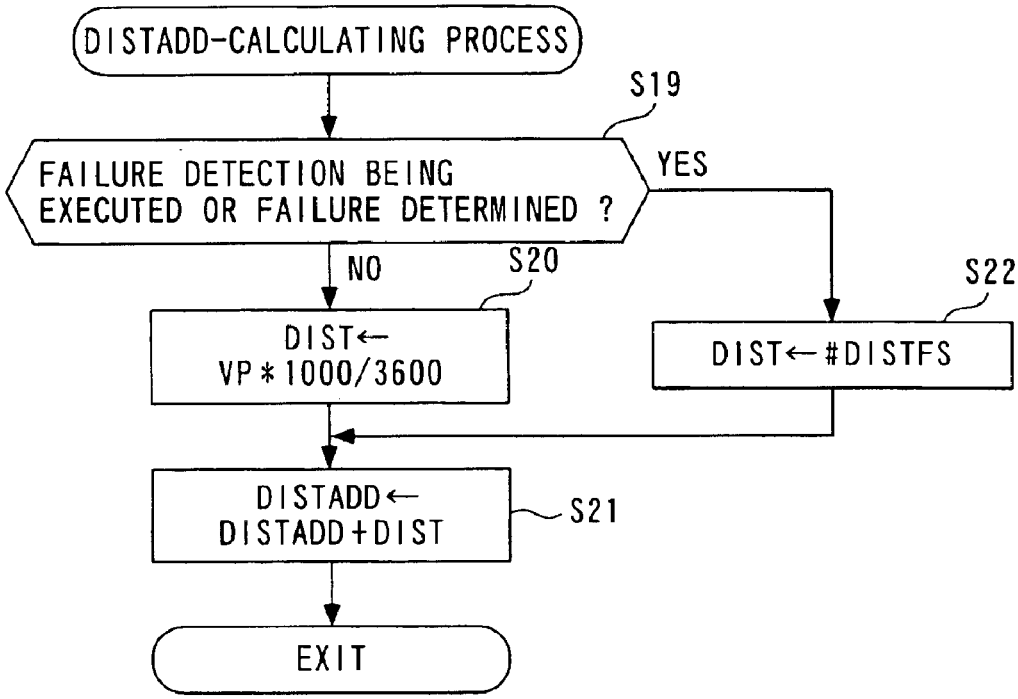
FIG. 8 is a flowchart of a subroutine for carrying out a cumulative travel distance-calculating process.

FIG. 8 shows a subroutine for carrying out the cumulative travel distance (DISTADD)-calculating process. In this process, first in step 19, it is determined whether or not failure detection for the vehicle speed sensor 12 necessary for calculation of the cumulative travel distance DISTADD is being carried out, or whether or not failure of the vehicle speed sensor 12 has been detected. If the answer to the question is negative (NO), i.e. if the vehicle speed sensor 12 is normal, a travel distance DIST (m) per second (hereinafter referred to as "the per-second travel distance DIST") is calculated by conversion from the vehicle speed VP (km/h) indicative of a travel distance per hour of the vehicle 4 (step 20).

On the other hand, if the answer to the question of the step 19 is affirmative (YES), i.e. if failure detection for the vehicle speed sensor 12 is being performed, the per-second travel distance DIST is set to a predetermined value #DISTFS (e.g. 8.3 m) for a failure time (step 22). Then, the per-second travel distance DIST calculated in the step 20 or 22 in the present loop is added to the cumulative travel distance DISTADD calculated up to the immediately preceding loop, to thereby obtain the present cumulative travel distance DISTADD (step 21), followed by terminating the DISTADD-calculating process.

Figure 9:
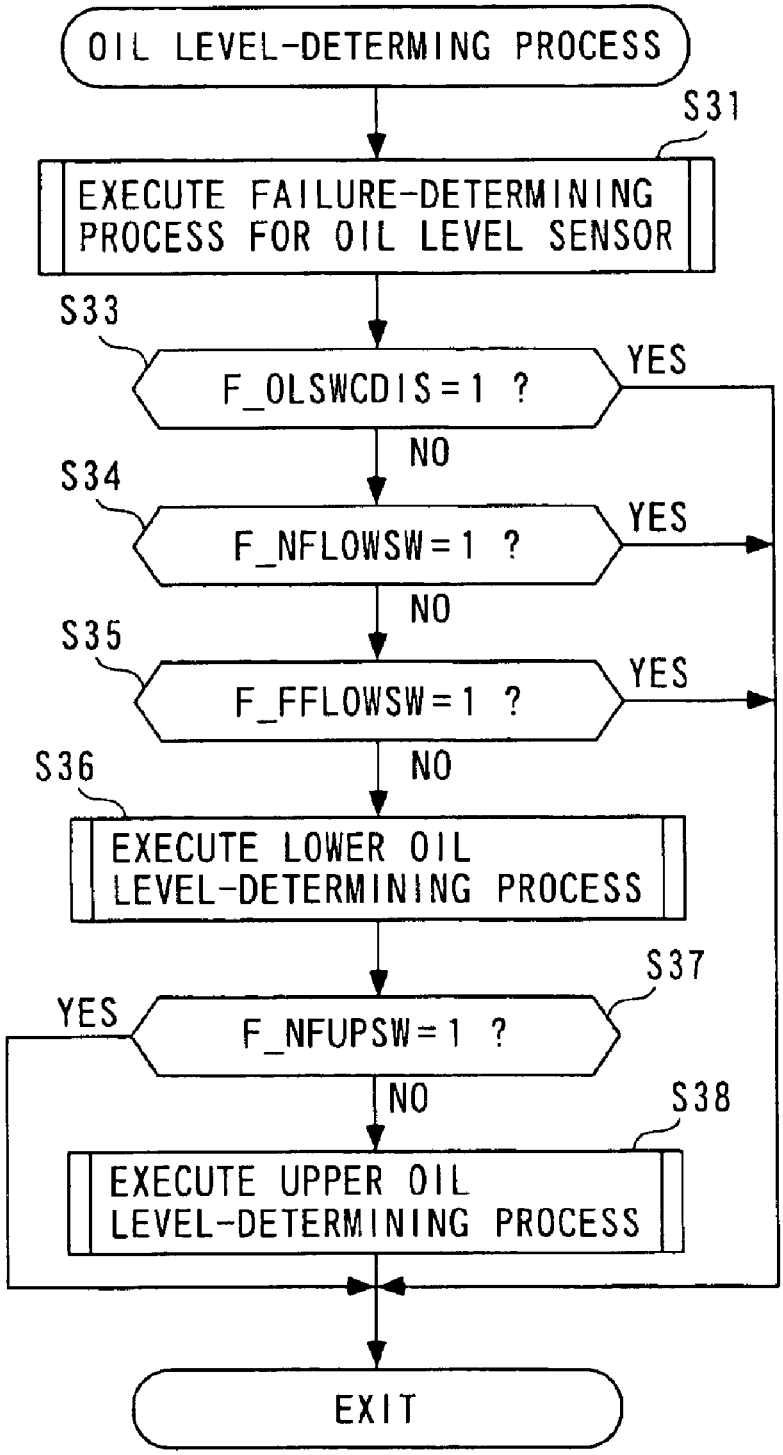
FIG. 9 is a flowchart of a subroutine for carrying out an oil level-determining process.

FIG. 9 shows the subroutine for carrying out the oil level-determining process executed in the step 3 in FIG. 3. In the present process, first in a step 31, a process for determining failure of the oil level sensor 7 is executed. This failure-determining process is carried out when the engine 3 is in a predetermined operating condition, so as to determine failure of the upper and lower limit switches 7*a*, 7*b* based on whether each of the upper and lower limit switches 7*a*, 7*b* is in the ON or OFF state as it should be in the predetermined operating condition of the engine 3.

More specifically, when the lower limit switch 7*b* is in the OFF state in an operating condition where the engine rotational speed NE is equal to or higher than a predetermined first rotational speed NREF1 (e.g. 5000 rpm) and the oil temperature TOIL is equal to or lower than a predetermined temperature TREF (e.g. 80° C.), it is judged that the lower limit switch 7*b* is faulty in a state fixed to the OFF side (upper oil level-indicating side) because under such an operating condition of the engine, the engine oil EO is circulated (drawn out from the oil pan 2) at such a large flow rate that the oil level in the oil pan 6 should be equal to or lower than the second lower limit level OLL2, i.e. the lower limit switch 7*b* should be in the ON state, and hence a lower limit switch OFF-side failure flag F_FFLOWSW is set to 1. Further, when the lower limit switch 7*b* remains in the ON state when a predetermined time period has elapsed after stoppage of the engine 3, it is judged that the lower limit switch 7*b* is faulty in a state fixed to the ON side (lower oil level-indicating side) because under such an operating condition of the engine without no flow of the engine oil EO, the oil level in the oil pan 2 should be equal to or higher than the first lower limit level OLL1, i.e. the lower limit switch 7*b* should be in the OFF state, and hence a lower limit switch ON-side failure flag F_NFLOWSW is set to 1. Further, when the upper limit switch 7*a* is in the ON state in an operating condition where the engine rotational speed NE is equal to or higher than a predetermined second rotational speed NREF2 (e.g. 3000 rpm) lower than the first rotational speed NREF1 and the oil temperature TOIL is equal to or lower than the predetermined temperature TREF, it is judged that the upper limit switch 7*a* is faulty in a state fixed to the ON side (upper oil level-indicating side) for the reason similar to the case of the lower limit switch 7*b* being fixed to the OFF side, and a upper limit switch ON-side failure flag F_NFUPSW is set to 1.

After execution of the failure-determining process, the process proceeds to a step 33, wherein it is determined whether or not a disconnection flag F_OLSWCDIS assumes 1. This disconnection flag F_OLSWCDIS is set to 1 when a proper voltage is not output from the oil level sensor 7 e.g. due to detachment of a coupler, not shown, from the oil level sensor 7 or a break of an electric circuit thereof. Therefore, if the answer to the question of the step 33 is affirmative (YES), it is judged that proper oil level determination cannot be performed, and hence the present process is immediately terminated.

On the other hand, if the answer to the question of the step 33 is negative (NO), the process proceeds to a step 34, wherein it is determined whether or not the lower limit switch ON-side failure flag F_NFLOWSW assumes 1. If the answer to the question is affirmative (YES), i.e. when it is determined in the failure-determining process that the lower limit switch 7*b* is faulty in the state fixed to the ON side, the present process is immediately terminated without executing a lower limit oil level-determining process, described hereinbelow. If the answer to the question of the step 34 is negative (NO), the process proceeds to a step 35, wherein it is determined whether or not the lower limit switch OFF-side failure flag F_FFLOWSW assumes 1. If the answer to this question is affirmative (YES), i.e. when it is determined in the failure-determining process that the lower limit switch 7*b* is faulty in the state fixed to the OFF side, the present process is immediately terminated without executing the lower limit oil level-determining process, similarly to the above.

On the other hand, if the answer to the question of the step 35 is negative (NO), i.e. if the lower limit switch 7*b* is not faulty either on the ON side or on the OFF side, the process proceeds to a step 36, wherein the lower limit oil level-determining process is executed.

Figure 10:
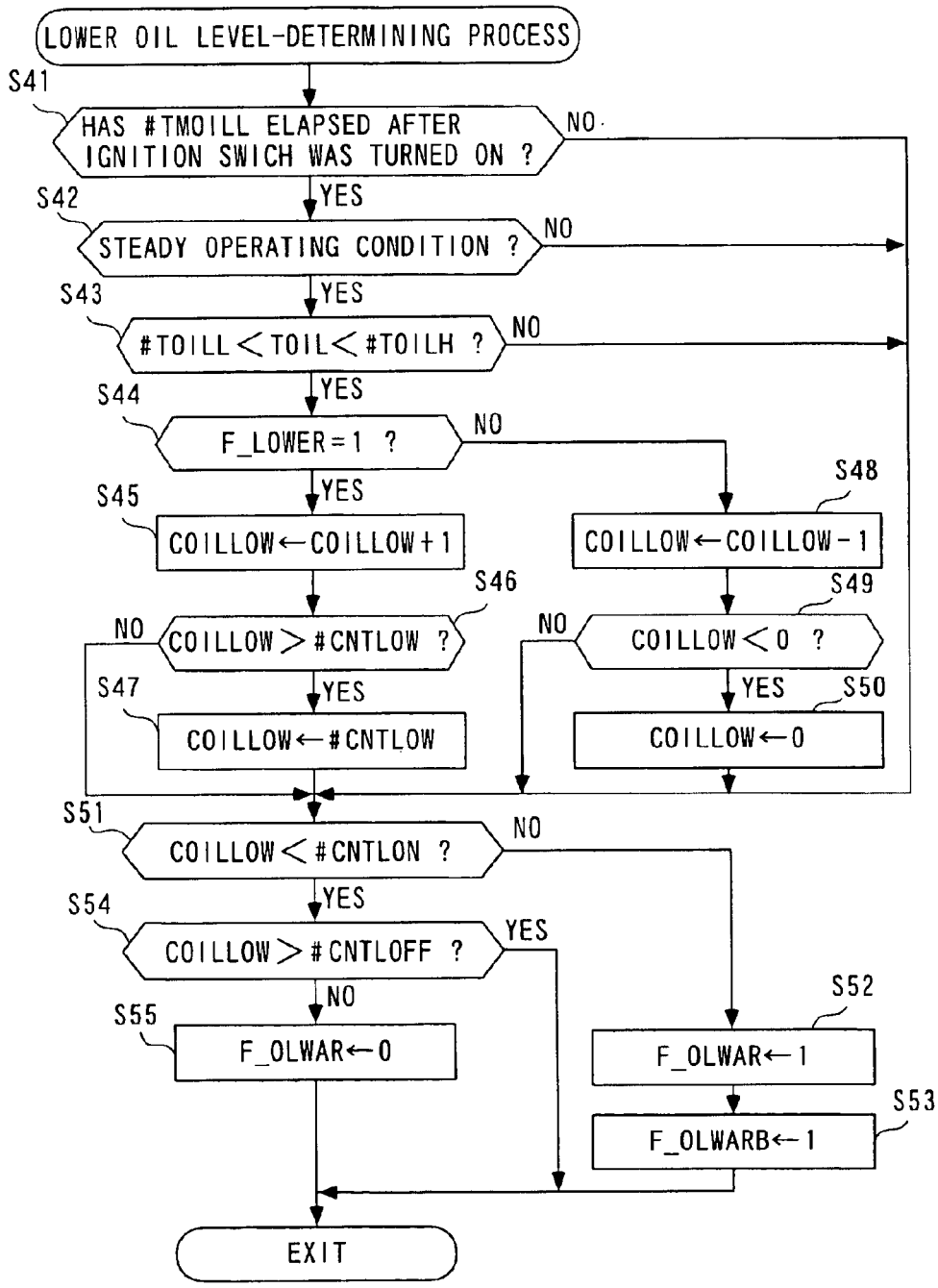
FIG. 10 is a flowchart of a subroutine for carrying out a lower limit oil level-determining process.

FIG. 10 shows a subroutine for carrying out the lower limit oil level-determining process. This process is executed so as to determine, based on the ON/OFF state of the lower limit switch 7*b*, whether or not the oil level OL has been lowered to a level requiring replenishment of the engine oil FO. In the present process, as shown in FIG. 10, first in a step 41, it is determined whether or not a predetermined time period #TMOILL (e.g. 10 minutes) has elapsed after the ignition switch, not shown, was turned on. If the answer to this question is affirmative (YES), the process proceeds to a step 42, wherein it is determined whether or not the engine 3 is in a predetermined steady operating condition. The steady operating condition is, for instance, an operating condition where the vehicle speed VP, the engine rotational speed NE, and the engine coolant temperature TW are within respective predetermined ranges.

If the answer to the question of the step 42 is affirmative (YES), i.e. if the engine 3 is in the steady operating condition, the process proceeds to a step 43, wherein it is determined whether or not the oil temperature TOIL is within a predetermined range defined between a predetermined lower limit temperature #TOILL (e.g. 40° C.) and a predetermined upper limit temperature #TOILH (e.g. 100° C.), as a suitable range for detection of the oil level OL. If the answer to the question is affirmative (YES), i.e. if #TOILL<TOIL<#TOILH holds, the process proceeds to a step 44, wherein it is determined whether or not an oil level lower limit flag F_LOWER assumes 1. This oil level lower limit flag F_LOWER is set to 1 when the lower limit switch 7*b* of the oil level sensor 7 is in the ON state.

If the answer to the question of the step 44 is affirmative (YES), i.e. if the lower limit switch 7*b* is in the ON state, a lower limit oil level counter COILLOW is incremented by 1 (step 45). Then, in a step 46, it is determined whether or not the count of the lower limit oil level counter COILLOW is larger than its limit value #CNTLOW (e.g. 50). If the answer to the question is affirmative (YES), i.e. if COILLOW>#CNTLOW holds, the lower limit oil level counter COILLOW is set to the limit value #CNTLOW (step 47), and then the process proceeds to a step 51, referred to hereinafter, whereas if the answer to the question of the step 46 is negative (NO), the step 47 is skipped over to the step 51.

On the other hand, if the answer to the question of the step 44 is negative (NO), i.e. if the lower limit switch 7*b* is in the OFF state, the lower limit oil level counter COILLOW is decremented by 1 (step 48). Then, it is determined whether or not the count of the lower limit oil level counter COILLOW is smaller than 0 (step 49). If the answer to the question is affirmative (YES), the lower limit oil level counter COILLOW is set to 0 (step 50), and then the process proceeds to the step 51, whereas if the answer to the question of the step 49 is negative (NO), the step 50 is skipped over to the step 51. It should be noted that if the answer to the question of the step 42 or 43 is negative (NO), the process also proceeds to the step 51.

In the step 51, it is determined whether or not the count of the lower limit oil level counter COILLOW is smaller than a predetermined warning execution reference value #CNTLON (e.g. 50). If the answer to the question is negative (NO), i.e. if COILLOW ≧#CNTLON holds, it is judged that the frequency with which the lower limit switch 7*b* is switched to the ON state is high and hence the oil level OL has been lowered to the level requiring replenishment of the engine oil EO, and an oil level-warning flag F_OLWAR is set to 1 so as to inform the driver of the fact (step 52). Then, an oil level-warning completion flag F_OLWARB is set to 1 so as to indicate that the warning has been given (step 53), followed by terminating the present process. When the flag F_OLWAR is set to 1 in the step 52, the warning lamp is lit. It should be noted that the oil level-warning completion flag F_OLWARB is stored in a backup RAM, so that the present value is held even after stoppage of the engine 3.

On the other hand, if the answer to the question of the step 51 is affirmative (YES), i.e. if COILLOW<#CNTLON holds, it is determined whether or not the count of the lower limit oil level counter COILLOW is larger than a predetermined warning cancellation reference value #CNTLOFF (e.g.20) (step 54). If the answer to the question is affirmative (YES), the present process is immediately terminated, and the oil level-warning flag F_OLWAR set to 1 in the step 52 is maintained. On the other hand, if the answer to the question of the step 54 is negative (NO), i.e. if COILLOW≦#CNTLOFF holds, it is judged that the oil level OL has been raised by a change or replenishment of the engine oil EO, and hence the oil level-warning flag F_OLWAR is reset to 0 (step 55), followed by terminating the present process. In response to this, the warning lamp 16 in the ON state is extinguished.

Referring again to FIG. 9, in a step 37 following the step 36, it is determined whether or not the upper limit switch ON-side failure flag F_NFUPSW assumes 1. If the answer to the question is affirmative (YES), i.e. when it is determined in the failure-determining process that the upper limit switch 7*a* is faulty in the sate fixed to the ON side, the oil level-determining process is immediately terminated without executing an upper limit oil level-determining process described in detail hereinbelow. On the other hand if the answer to the question of the step 37 is negative (NO), i.e. if the upper limit switch 7*a* is normal, the process proceeds to a step 38, wherein the upper limit oil level-determining process is executed, followed by terminating the oil level-determining process.

Figure 11:
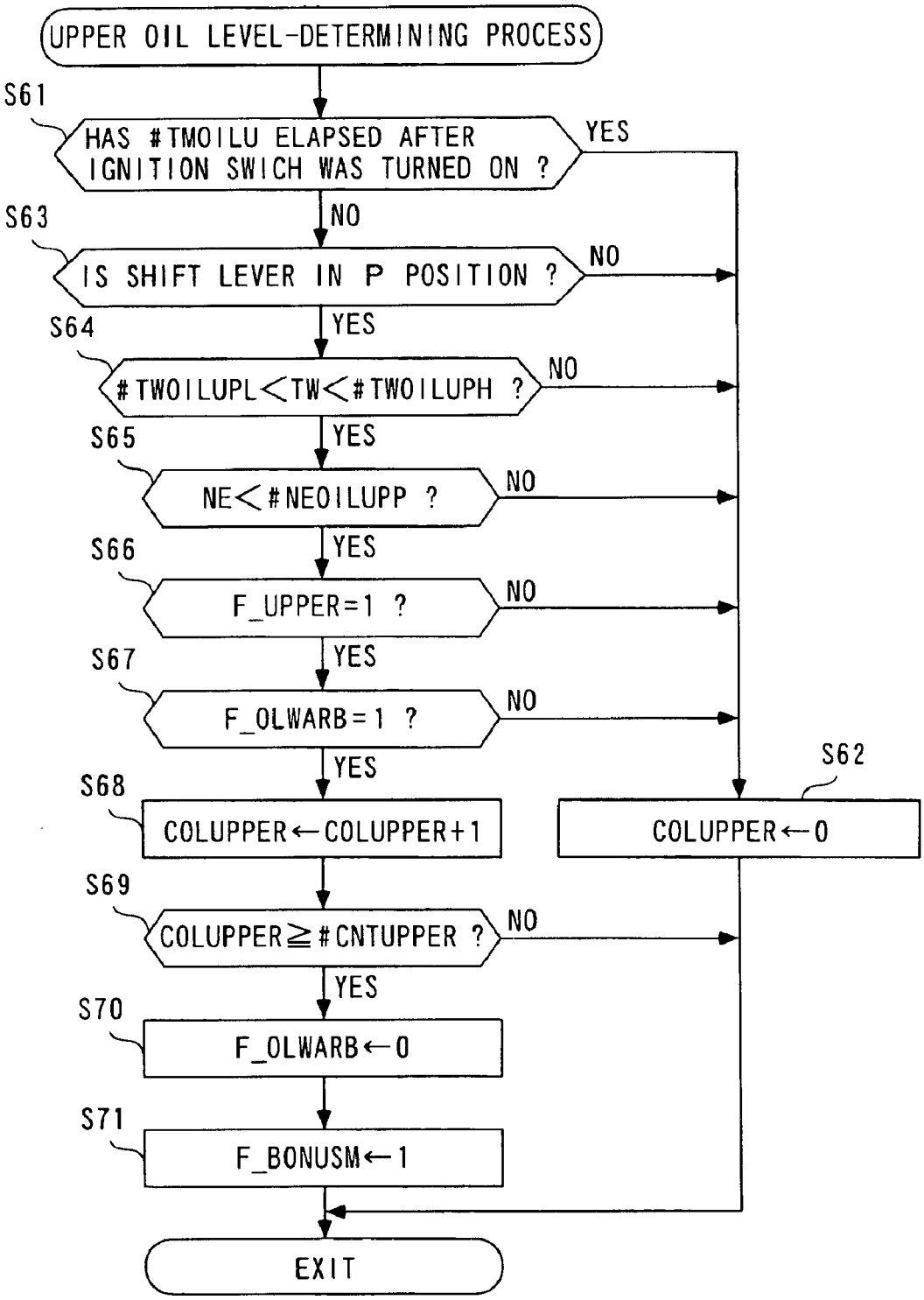
FIG. 11 is a flowchart of a subroutine for carrying out an upper limit oil level-determining process.

FIG. 11 shows a subroutine for carrying out the upper limit oil level-determining process. This process is executed so as to determine, based on the ON/OFF state of the upper limit switch 7*a*, whether or not the oil level OL has been restored to a sufficiently high level, i.e. whether or not a sufficient amount of engine oil EO has been replenished. The present process is carried out at intervals of a predetermined time period (e.g. 100 msec.). In the present process, first in a step 61, it is determined whether or not a predetermined time period #TMOILU (e.g. 1 second) shorter than the predetermined time period #TMOILL used in the step 41 in FIG. 10 has elapsed after the ignition switch was turned on. If the answer to the question is affirmative (YES), i.e. if the predetermined time period #TMOILU has elapsed after the ignition switch was turned on, an upper limit oil level counter COLUPPER is set to 0 (step 62), followed by terminating the present process.

On the other hand, if the answer to the question of the step 61 is negative (NO), the process proceeds to a step 63, wherein it is determined whether or not a shift lever (not shown) is in a P position. If the answer to the question is affirmative (YES), it is determined whether or not the engine coolant temperature TW is between a predetermined lower limit temperature #TWOILUPL (e.g. −30° C.) and a predetermined upper limit temperature #TWOILUPH (e.g. 100° C.) (step 64). If the answer to the question is affirmative (YES), i.e. if #TWOILUPL<TW<#TWOILUPH holds, it is judged that the engine coolant temperature TW is within a temperature range suitable for the upper limit oil level determination, and the process proceeds to a step 65.

In the step 65, it is determined whether or not the engine rotational speed NE is lower than a predetermined rotational speed #NEOILUPP (e.g. 1500 rpm). If the answer to the question is affirmative (YES), i.e. if NE<#NEOILUPP holds, which means that the engine 3 is in stoppage or rotating at a low rotational speed, it is determined whether or not an oil level upper limit flag F_UPPER assumes 1 (step 66). This oil level upper limit flag F_UPPER is set to 1 when the upper limit switch 7*a* is in the ON state.

If the answer to the question of the step 66 is affirmative (YES), i.e. if the upper limit switch 7*a* is in the ON state, the process proceeds to a step 67, wherein it is determined whether or not the oil level-warning completion flag F_OLWARB assumes 1. If the answer to the question is affirmative (YES), i.e. when it is determined in the lower limit oil level-determining process in FIG. 10 that the oil level OL has been lowered, and the driver has already been warned of the fact, the upper limit oil level counter COLUPPER is incremented by 1 (step 68). Then, the process proceeds to a step 69, wherein it is determined whether or not the count of the upper limit oil level counter COLUPPER is equal to or larger than a predetermined reference value #CNTUPPER (e.g. 7). If the answer to the question is negative (NO), i.e. if COLUPPER<#CNTUPPER holds, the present process is immediately terminated.

On the other hand, if the answer to the question of the step 69 is affirmative (YES), i.e. if COLUPPER≧#CNTUPPER holds, it is judged that the oil level OL has been undoubtedly restored to a sufficiently high level, i.e. that a sufficient amount of engine oil EO has been replenished, and the oil level-warning completion flag F_OLWARB is reset to 0 (step 70). Then, a subtractive correction-permitting flag F_BONUSM, referred to hereinafter, is set to 1 (step 71), followed by terminating the present process.

On the other hand, if the answer to the question of any one of the steps 63 to 67 is negative (NO), the step 62 is executed to set the upper limit oil level counter COLUPPER to 0, followed by terminating the present process.

Figure 12:
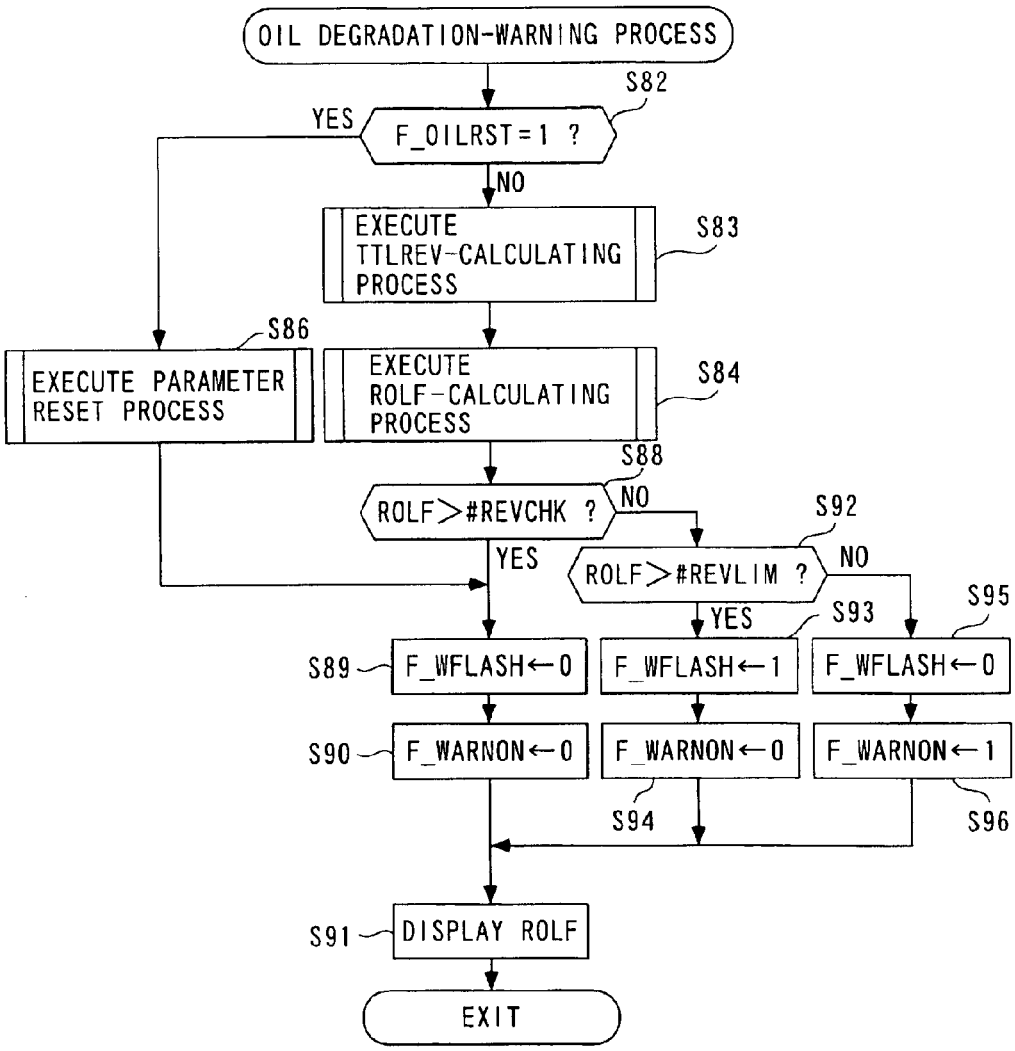
FIG. 12 is a flowchart of a subroutine for carrying out an oil degradation-warning process.

FIG. 12 shows a subroutine for carrying out the oil degradation-warning process executed in the step 4 in FIG. 3. In the present process, first in a step S82, it is determined whether or not the oil change-determining flag F_OILPST assumes 1. If the answer to the question is negative (NO), which means that the present loop is not being executed immediately after an oil change, a cumulative number of revolutions TTLREV of the engine 3 (hereinafter simply referred to as "the cumulative revolution number TTREV") is calculated as a degradation level parameter (step 83). The cumulative revolution number TTREV is reset to 0, as described hereinafter, when the oil change-determining flag F_OILPST is set to 1 immediately after a change of the engine oil OL, and hence it indicates a cumulative number of revolutions of the engine 3 after the oil change.

Figure 13:
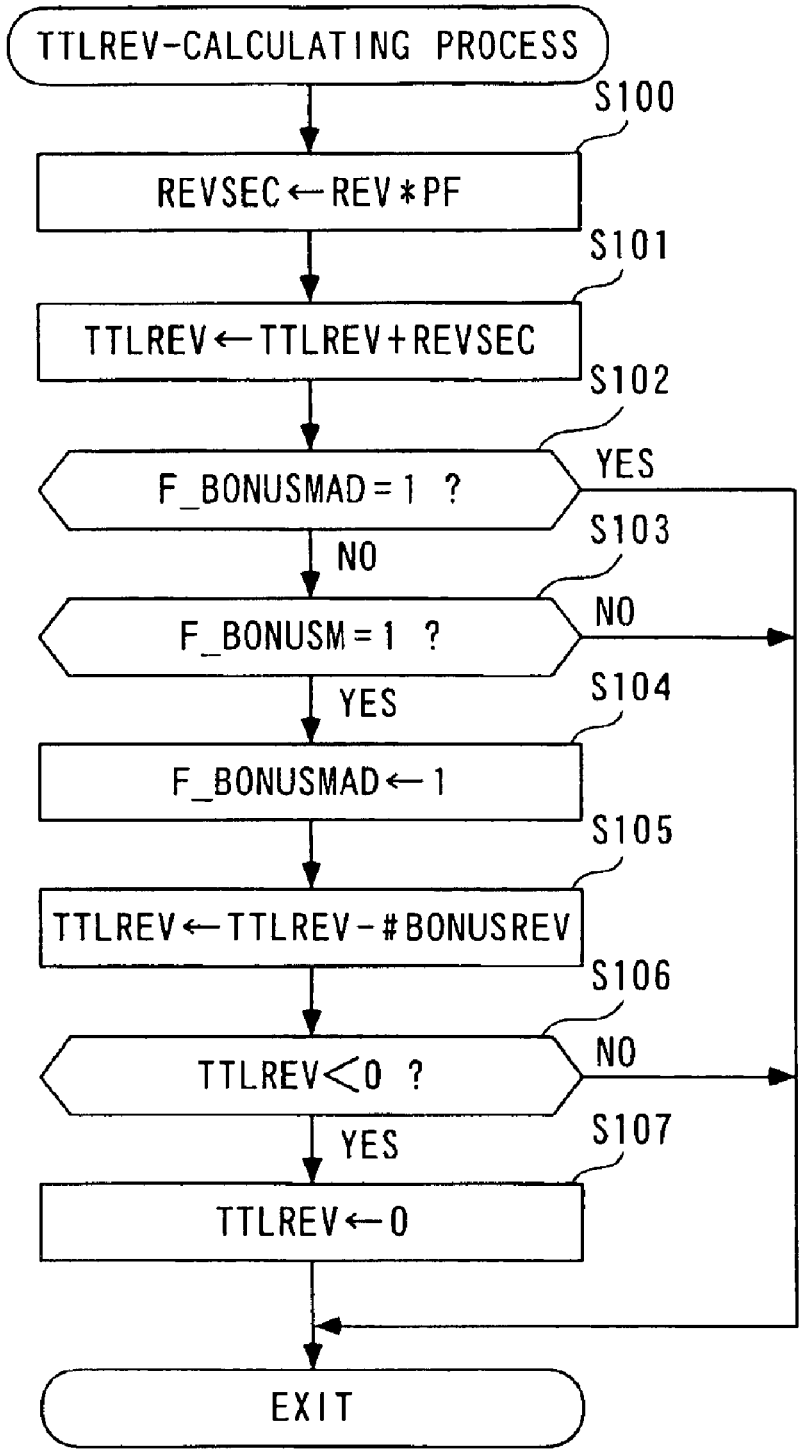
FIG. 13 is a flowchart of a subroutine for carrying out a cumulative revolution number-calculating process.

FIG. 13 shows a subroutine for carrying out a process for calculating the cumulative revolution number TTREV. In the TTLREV-calculating process, first in a step 100, the revolutions-per-second number REV calculated in the step 13 in FIG. 5 is multiplied by the degradation coefficient PF calculated in the step 17 or 18 in FIG. 6, to thereby obtain a post-oil temperature correction revolution number REVSEC. Then, the post-oil temperature correction revolution number REVSEC calculated in the present loop is added to the cumulative revolution number TTREV calculated up to the immediately preceding loop, to thereby obtain the present cumulative revolution number TTREV (step 101).

Then, it is determined whether or not a subtractive correction completion flag F_BONUSMAD assumes 1 (step 102). If the answer to the question is negative (NO), it is determined whether or not the aforementioned subtractive correction-permitting flag F_BONUSM assumes 1 (step 103). If the answer to the question is negative (NO), the present process is immediately terminated.

On the other hand, if the answer to the question of the step 103 is affirmative (YES), i.e. when it is determined in the upper limit oil level-determining process in FIG. 11 that engine oil EO has been replenished after lowering of the oil level OL, the subtractive correction completion flag F_BONUSMAD is set to 1 (step 104), and then a value obtained by subtracting a predetermined subtracting revolution number #BONUSREV (e.g. seven million revolutions) from the cumulative revolution number TTREV is set as the present cumulative revolution number TTREV (step 105). This subtractive correction allows the cumulative revolution number TTREV to reflect the fact that the service life of the engine oil EO has been prolonged by oil replenishment. Since the step 104 has been executed, the answer to the question of the step 102 in the following loops after the present subtractive correction of the cumulative revolution number TTREV becomes affirmative (YES), so that the present process comes to be immediately terminated. This means that the subtractive correction of the cumulative revolution number TTREV in response to replenishment of the engine oil EO is executed only once.

Then, it is determined whether or not the cumulative revolution number TTREV corrected in the step 105 is smaller than 0 (step 106). If the answer to the question is negative (NO), the present process is immediately terminated, whereas if the answer to the question is affirmative (YES), i.e. if TTLREV<0 holds, the TTLREV value is reset to 0 (step 107), followed by terminating the present process.

Figure 14:
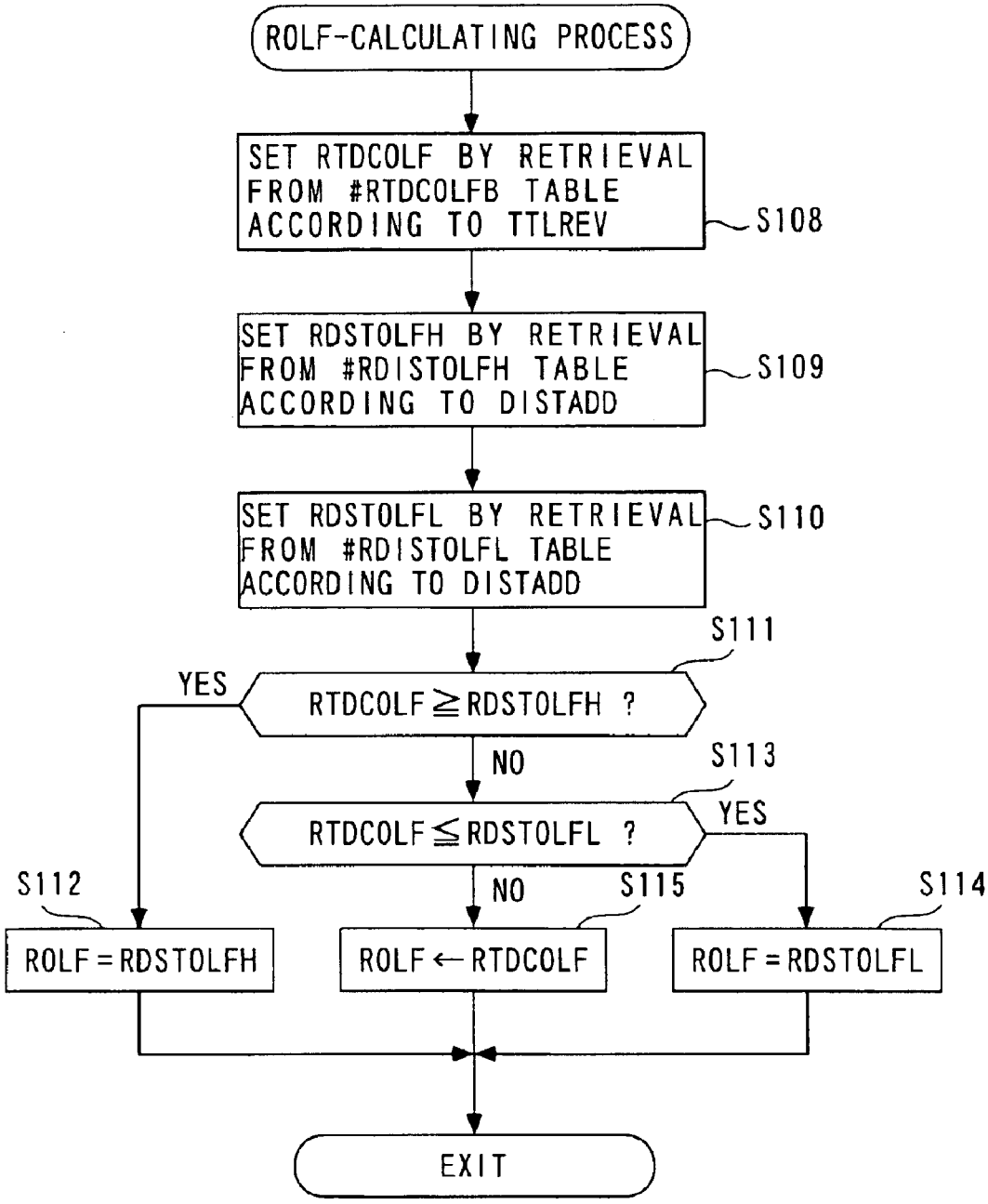
FIG. 14 is a flowchart of a subroutine for carrying out a remaining oil life-calculating process.

Referring again to FIG. 12, in a step 84 following the step 83, the remaining oil life value ROLF is calculated. FIG. 14 shows a subroutine for carrying out a process for calculating the remaining oil life value ROLF. In the remaining oil life value (ROLF)-calculating process, the remaining oil life value ROLF indicative of a degradation level of the engine oil EO is calculated based on the cumulative revolution number TTREV calculated in the step 83 and the cumulative travel distance DISTADD calculated in the step 15 in FIG. 5.

Figure 15:
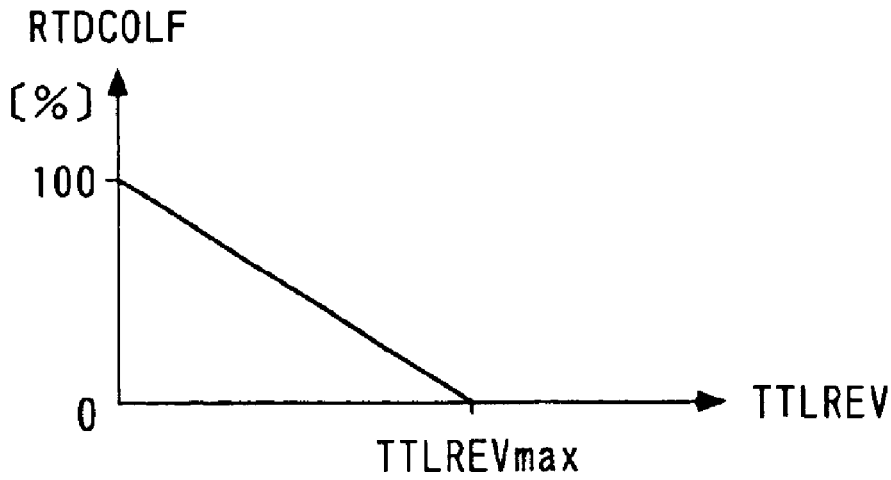
FIG. 15 is a diagram showing tables for use in setting a temporary oil life value.

First, in a step 108, a temporary oil life value RTDCOLF is set by retrieval from an RTDCOLF table shown in FIG. 15 according to the cumulative revolution number TTREV. The temporary oil life value RTDCOLF is a remaining life of the engine oil EO expressed as a percentage. In the RTDCOLF table, the temporary oil life value RTDCOLF is set to 100% when the cumulative revolution number TTREV is equal to 0, i.e. immediately after a change of the engine oil EO, and to 0% when the cumulative revolution number TTREV is equal to a predetermined maximum value TTLREVmax (e.g. 30 million revolutions). Further, in the table, the temporary oil life value RTDCOLF is set such that it linearly decreases from 100% to 0% as the cumulative revolution number TTREV increases between the above values.

Figure 16:
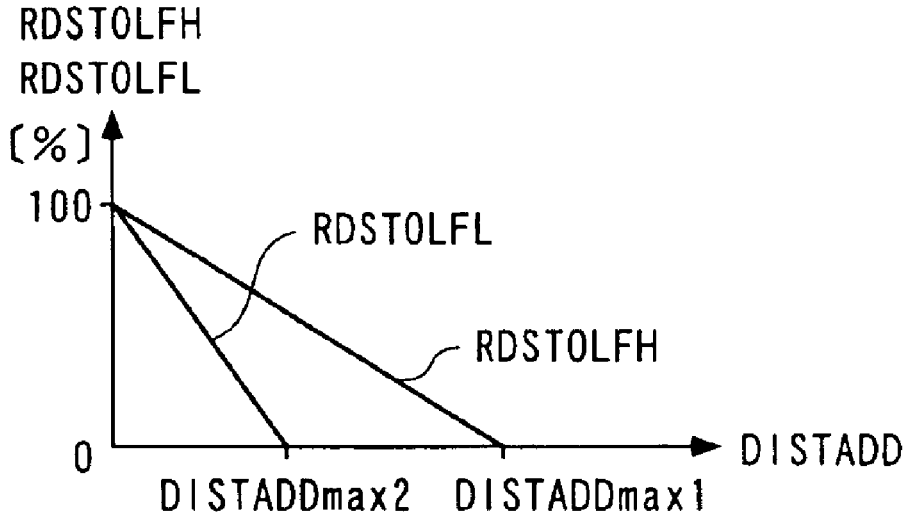
FIG. 16 is a diagram showing tables for use in setting an upper limit oil life value and a lower limit oil life value.
Figure 1:
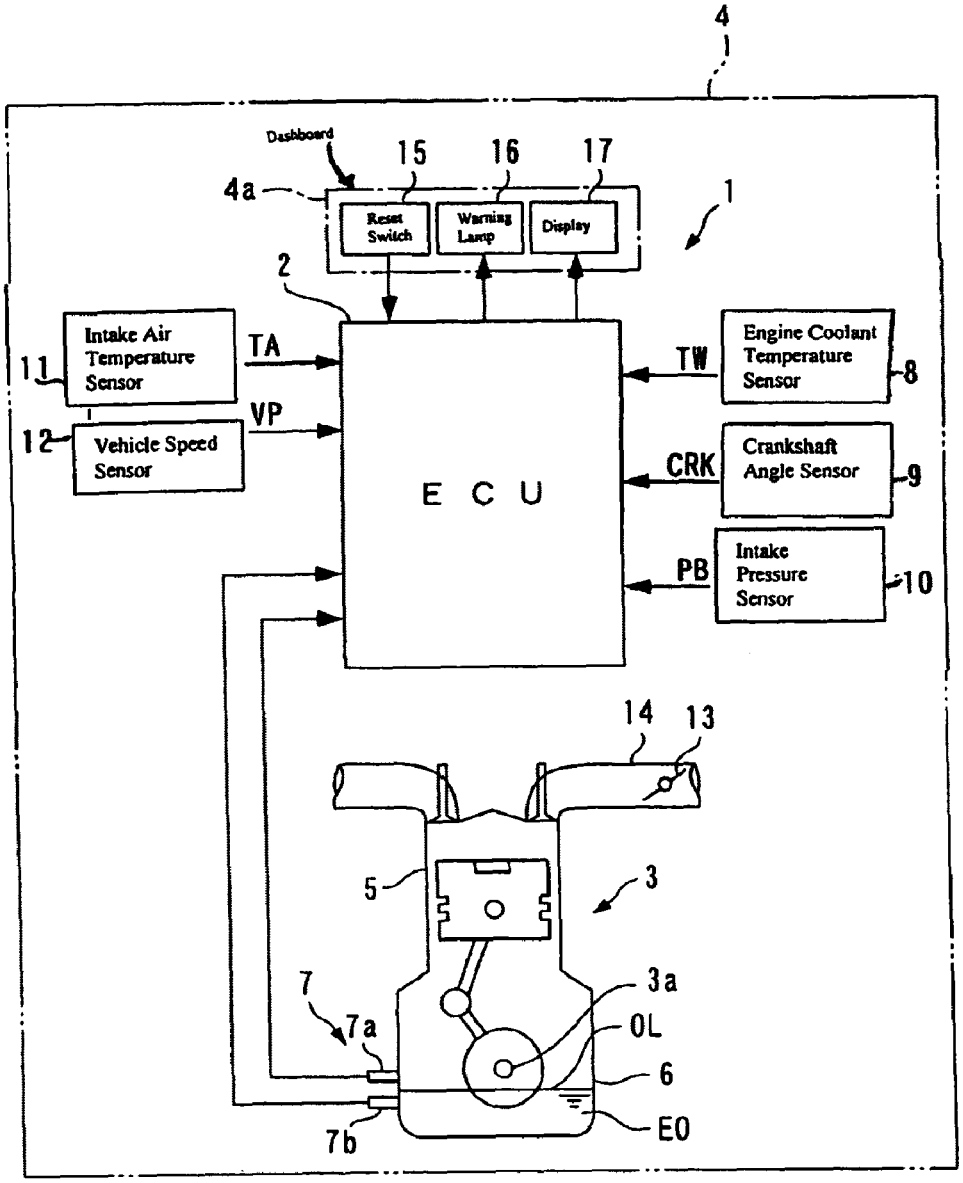
Figure 2:
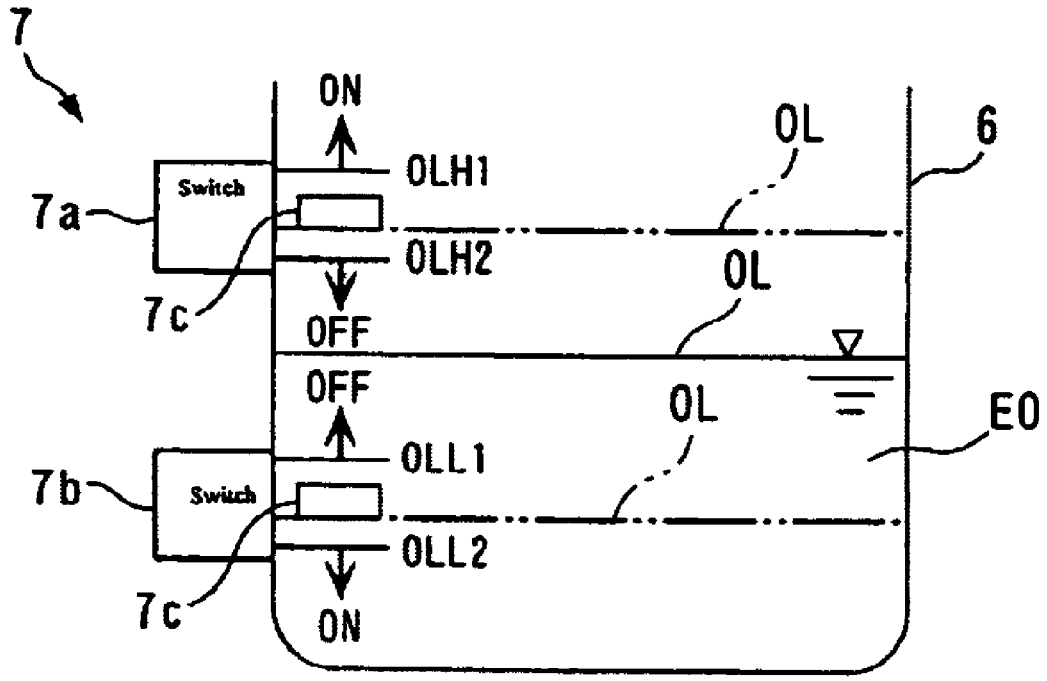

Then, an upper limit oil life value RDSTOLFH is set by retrieval from an RDSTOLFH table shown in FIG. 16 according to the cumulative travel distance DISTADD (step 109). The upper limit oil life value RDSTOLFH is an upper limit value of the remaining life of the engine oil EO expressed as a percentage. In the RDSTOLFH table, the upper limit oil life value RDSTOLFH is set to 100% when the cumulative travel distance DISTADD is equal to 0 immediately after an oil change, and to 0% when the cumulative travel distance DISTADD is equal to a predetermined first upper limit value DISTADDmax1 (e.g. 16000 km). Further, in the table, the upper limit oil life value RDSTOLFH is set such that it linearly decreases from 100% to 0% as the cumulative travel distance DISTADD increases between the above values.

Then, a lower limit oil life value RDSTOLFL is set by retrieval from an RDSTOLFL table shown in FIG. 16 according to the cumulative travel distance DISTADD (step 110). The lower limit oil life value RDSTOLFL is a lower limit value of the remaining life of the engine oil EO expressed as a percentage. In the RDSTOLFL table, the lower limit oil life value RDSTOLFL is set to 100% when the cumulative travel distance DISTADD is equal to 0 immediately after an oil change, and to 0% when the cumulative travel distance DISTADD is equal to a predetermined second upper limit value DISTADDmax2 (e.g. 6000 km) smaller than the first upper limit value DISTADDmax1. Further, in the table, the lower limit oil life value RDSTOLFL is set such that it linearly decreases from 100% to 0% as the cumulative travel distance DISTADD increases between the above values.

Then, it is determined whether or not the temporary oil life value RTDCOLF set in the step 108 is equal to or larger than the upper limit oil life value RDSTOLFH set in the step 109 (step 111). If the answer to the question is affirmative (YES), i.e. if RTDCOLF≧RDSTOLFH holds, the remaining oil life value ROLF is set to the upper limit oil life value RDSTOLFH (step 112).

On the other hand, if the answer to the question of the step 111 is negative (NO), it is determined whether or not the temporary oil life value RTDCOLF is equal to or smaller than the lower limit oil life value RDSTOLFL (step 113). If the answer to the question is affirmative (YES), i.e. if RTDCOLF≦RDSTOLFL holds, the remaining oil life value ROLF is set to the lower limit oil life value RDSTOLFL (step 114). Further, if the answer to the question is negative (NO), i.e. if RDSTOLFL<RTDCOLF<RDSTOLFH holds, the remaining oil life value ROLF is set to the temporary oil life value RTDCOLF (step 115), followed by terminating the present process.

The temporary oil life value RTDCOLF is set based on the cumulative revolution number TTREV as described above, and hence varies according to manners in which the vehicle 4 is driven. For instance, when idle operating state continues over a long time period, the cumulative revolution number TTREV increases, so that even though the engine oil EO is not yet so much degraded, the temporary oil life value RTDCOLF is set to a smaller value than it should be. Therefore, by applying a limiting process to the temporary oil life value RTDCOLF in the steps 111 to 114 such that the value RTDCOLF can be held between the upper and lower limit oil life values RDSTOLFH and RDSTOLFL set according to the cumulative revolution number TTREV, it is possible to compensate for the variation mentioned above, thereby properly setting the remaining oil life value ROLF.

Referring again to FIG. 12, in a step 88 following the step 84, it is determined whether or not the calculated remaining oil life value ROLF is larger than a predetermined warning reference value #REVCHK (e.g. 10%). If the answer to the question is affirmative (YES), a warning flashing flag F_WFLASH and a warning ON flag F_WARON are each set to 0 (steps 89, 90). More specifically, when the remaining oil life value ROLF is larger than the reference value #REVCHK, it is judged that the engine oil EO is not yet degraded to a level requiring warning, and the warning lamp 16 is held in an OFF state. Then, the remaining oil life value ROLF is displayed on the display 17 as information to the driver, followed by terminating the oil degradation-warning process.

On the other hand, if the answer to the question of the step 88 is negative (NO), i.e. if ROLF≦#REVCHK holds, it is determined whether or not the remaining oil life value ROLF is larger than a predetermined limit value #REVLIM (e.g. 0%) (step 92). If the answer to the question is affirmative (YES), i.e. if #REVLIM<ROLF≦#REVCHK holds, the warning flashing flag F_WFLASH is set to 1 (step 93), and the warning ON flag F_WARON is set to 0 (step 94). More specifically, it is judged that the engine oil EO is degraded to a level requiring an oil change, and the warning lamp 16 is flashed so as to inform the driver of the fact. Then, the process proceeds to the step 91, and the remaining oil life value ROLF is displayed on the display 17, followed by terminating the oil degradation-warning process.

If the answer to the question of the step 92 is negative (NO), i.e. if the remaining oil life value ROLF has reached the limit value #REVLIM, the warning flashing flag F_WFLASH is set to 0 (step 95), and the warning ON flag F_WARON is set to 1 (step 96). More specifically, it is judged that the engine oil EO is degraded to the level requiring an oil change immediately, and the warning lamp 16 is turned on so as to inform the driver of the fact. Then, the process proceeds to the step 91, and the remaining oil life value ROLF is displayed on the display 17, followed by terminating the oil degradation-warning process.

On the other hand, if the answer to the question of the step 82 is affirmative (YES), i.e. if the oil change-determining flag F_OILRST assumes 1, which means that the present loop is being executed immediately after an oil change, a parameter reset process is carried out in a step 86. In this process, all the parameters including the cumulative travel distance DISTADD and the cumulative revolution number TTREV are reset to 0. Thereafter, the warning flashing flag F_WFLASH and the warning ON flag F_WARON are each set to 0 by executing the steps 89 to 91, and the remaining oil life value ROLF is displayed on the display 17, followed by terminating the oil degradation-warning process.

As described above, according to the degradation-determining system 1 of the present embodiment, in the FIG. 10 lower limit oil level-determining process, the ON state of the lower limit switch 7*b* of the oil level sensor 7 is counted by the lower limit oil level counter COILLOW, and when the count of the counter COILLOW becomes equal to or larger than the predetermined warning execution reference value #CNTLON (NO to step 51), it is judged that the oil level OL has been lowered to a level requiring an oil change (step 53). Further, subsequently, in the FIG. 11 upper limit oil level-determining process, the ON state of the upper limit switch 7*a* of the oil level sensor 7 is counted by the upper limit oil level counter COILUPPER during the predetermined time period #TMOILU immediately following an ON operation of the ignition switch (start operation of the engine 3), and when the count of the counter COILUPPER becomes equal to or larger than the reference value #CNTUPPER (YES to step 69), it is judged that engine oil EO has been replenished during stoppage of the engine 3, and the subtractive correction-permitting flag F_BONUSM is set to 1 (step 71). Then, the cumulative revolution number TTREV for use in calculating the remaining oil life value ROLF is corrected by subtraction of the subtracting revolution number #BONUS-REV (step 105 in FIG. 13), i.e. corrected in the direction of lowering the degradation level.

As described above, in the present embodiment, it is determined whether or not engine oil EO has been replenished, under the condition that the oil level OL has sharply changed from a level equal to or lower than the second lower limit level OLL2 before stoppage of the engine 3 to a level equal to or higher than the first upper limit level OLH1 after the start of the engine 3. Therefore, differently from the conventional degradation-determining system which performs the determination by setting a single lower limit as a reference for determination, the present system is capable of accurately determining whether or not engine oil EO has been replenished, while positively avoiding erroneous determination caused by a slight variation in the oil level OL. Consequently, the present system is capable of properly correcting the cumulative revolution number TTREV by subtraction in response to an actual replenishment of the engine oil EO, and hence properly calculating the remaining oil life value ROLF based on the corrected cumulative revolution number TTREV, thereby performing accurate determination as to the degradation level of the engine oil EO.

Further, in the present degradation-determining system, it is not required to operate a manual reset switch for correction of the cumulative revolution number TTREV, as in the conventional degradation-determining system, and hence the present system is free from errors caused by a driver forgetting to operate the reset switch in the conventional system, which make it possible to reliably correct the cumulative revolution number TTREV in response to a replenishment of the engine oil EO. Furthermore, since it suffices to detect that the oil level OL is equal to or lower than the predetermined second lower limit level OLL2, and that the oil level OL is equal to or higher than the predetermined first upper limit level OLH1, the oil level-detecting means can be implemented by the relatively simple and inexpensive ON/OFF-type upper and lower limit switches 7*a*, 7*b* shown in the present embodiment. As a result, expensive sensors, such as a linear oil level sensor and a vehicle inclination sensor, for accurate detection of the oil level OL can be dispensed with, which makes it possible to realize the degradation-determining system 1 at low costs.

It should be noted that although in the above embodiment, only the cumulative revolution number TTREV is corrected in response to judgment that engine oil EO has been replenished, the cumulative travel distance DISTADD as another parameter for use in calculating the remaining oil life value ROLF may also be corrected. Alternatively, the remaining oil life value ROLF may be directly corrected. In these cases, correction is performed in the direction of lowering the degradation level. More specifically, the cumulative travel distance DISTADD is decreased for correction, while the remaining oil life value ROLF is increased for correction. Further, although in the above embodiment, the present invention is applied to an internal combustion engine for a vehicle, this is not limitative, but the invention is applicable to internal combustion engines of other industrial machines, e.g. to an internal combustion engine of a ship propulsion machine, such as an outboard engine having a crankshaft thereof disposed in a vertical direction.

It is further understood by those skilled in the art that the foregoing is a preferred embodiment of the invention, and that various changes and modifications may be made without departing from the spirit and scope thereof.

What is claimed is:

1. An engine oil degradation-determining system that determines a degradation level of engine oil for lubricating an internal combustion engine, the engine oil degradation-determining system comprising:

operating condition-detecting means for detecting an operating condition of the engine;

degradation level parameter-calculating means for calculating a degradation level parameter indicative of a degradation level of the engine oil, based on the detected operating condition;

degradation-determining means for determining the degradation level of the engine oil, based on the calculated degradation level parameter;

oil level-detecting means for detecting an oil level of the engine oil; and degradation level parameter-correcting means for correcting the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

2. An engine oil degradation-determining system as claimed in claim 1, wherein said oil level-detecting means comprises:

an upper limit switch for detecting whether or not the oil level is equal to or higher than the predetermined upper limit value, and a lower limit switch for detecting whether or not the oil level is equal to or lower than the predetermined lower limit value.

3. An engine oil degradation-determining system as claimed in claim 2, wherein said upper limit switch outputs an ON signal when the oil level is equal to or higher than the predetermined upper limit value, outputs an OFF signal when the oil level is equal to or lower than a second upper limit value lower than the predetermined upper limit value, and maintains the ON or OFF signal having been output before the oil level has entered a first range between the predetermined upper limit value and the second upper limit value when the oil level is in the first range, and wherein said lower limit switch outputs an ON signal when the oil level is equal to or lower than the predetermined lower limit value, outputs an OFF signal when the oil level is equal to or higher than a second lower limit value higher than the predetermined lower limit value, and maintains the ON or OFF signal having been output before the oil level has entered a second range between the predetermined lower limit value and the second lower limit value when the oil level is in the second range.

4. An engine oil degradation-determining system as claimed in claim 1, wherein the degradation level parameter is a cumulative number of revolutions of the engine counted starting from a time of an oil change.

5. An engine oil degradation-determining system as claimed in claim 4, wherein said degradation level parameter-calculating means includes means for carrying out a limiting process on the cumulative number of revolutions based on a cumulative travel distance of a vehicle on which the engine is installed, measured starting from the oil change.

6. An engine oil degradation-determining method of determining a degradation level of engine oil for lubricating an internal combustion engine, the engine oil degradation-determining method comprising the steps of:

detecting an operating condition of the engine;

calculating a degradation level parameter indicative of a degradation level of the engine oil, based on the detected operating condition;

determining the degradation level of the engine oil, based on the calculated degradation level parameter;

detecting an oil level of the engine oil; and correcting the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

7. An engine oil degradation-determining method as claimed in claim 6, wherein the step of detecting an oil level includes detecting the oil level using an upper limit switch for detecting whether or not the oil level is equal to or higher than the predetermined upper limit value, and a lower limit switch for detecting whether or not the oil level is equal to or lower than the predetermined lower limit value.

8. An engine oil degradation-determining method as claimed in claim 7, wherein said upper limit switch outputs an ON signal when the oil level is equal to or higher than the predetermined upper limit value, outputs an OFF signal when the oil level is equal to or lower than a second upper limit value lower than the predetermined upper limit value, and maintains the ON or OFF signal having been output before the oil level has entered a first range between the predetermined upper limit value and the second upper limit value when the oil level is in the first range, and wherein said lower limit switch outputs an ON signal when the oil level is equal to or lower than the predetermined lower limit value, outputs an OFF signal when the oil level is equal to or higher than a second lower limit value higher than the predetermined lower limit value, and maintains the ON or OFF signal having been output before the oil level has entered a second range between the predetermined lower limit value and the second lower limit value when the oil level is in the second range.

9. An engine oil degradation-determining method as claimed in claim 6, wherein the degradation level parameter is a cumulative number of revolutions of the engine counted starting from a time of an oil change.

10. An engine oil degradation-determining method as claimed in claim 9, wherein the step of calculating a degradation level parameter includes carrying out a limiting process on the cumulative number of revolutions based on a cumulative travel distance of a vehicle on which the engine is installed, measured starting from the oil change.

11. An engine control unit including a control program for causing a computer to determine a degradation level of engine oil for lubricating an internal combustion engine, wherein the program causes the computer to detect an operating condition of the engine, calculate a degradation level parameter indicative of a degradation level of the engine oil, based on the detected operating condition, determine the degradation level of the engine oil, based on the calculated degradation level parameter, detect an oil level of the engine oil, and correct the degradation level parameter in a direction of indicating a lower degradation level, when the detected oil level was equal to or lower than a predetermined lower limit value before stoppage of the engine, and is equal to or higher than a predetermined upper limit value higher than the predetermined lower limit value after start operation of the engine following the stoppage.

12. An engine control unit as claimed in claim 11, wherein when the control program causes the computer to detect an oil level, the control program causes the computer to detect the oil level using an output from an upper limit switch for detecting whether or not the oil level is equal to or higher than the predetermined upper limit value, and an output from a lower limit switch for detecting whether or not the oil level is equal to or lower than the predetermined lower limit value.

13. An engine control unit as claimed in claim 12, wherein said upper limit switch outputs an ON signal when the oil level is equal to or higher than the predetermined upper limit value, outputs an OFF signal when the oil level is equal to or lower than a second upper limit value lower than the predetermined upper limit value, and maintains the ON or OFF signal having been output before the oil level has entered a first range between the predetermined upper limit value and the second upper limit value when the oil level is in the first range, and wherein said lower limit switch outputs an ON signal when the oil level is equal to or lower than the predetermined lower limit value, outputs an OFF signal when the oil level is equal to or higher than a second lower limit value higher than the predetermined lower limit value, and maintains the ON or OFF signal having been output before the oil level has entered a second range between the predetermined lower limit value and the second lower limit value when the oil level is in the second range.

14. An engine control unit as claimed in claim 11, wherein the degradation level parameter is a cumulative number of revolutions of the engine counted starting from a time of an oil change.

15. An engine control unit as claimed in claim 14, wherein when the control program causes the computer to calculate the degradation level parameter, the control program causes the computer to carry out a limiting process on the cumulative number of revolutions based on a cumulative travel distance of a vehicle on which the engine is installed, measured starting from the oil change.

* * * * *

UNITED STATES PATENT AND TRADEMARK OFFICE

CERTIFICATE OF CORRECTION

PATENT NO. : 6,917,865 B2 
DATED : July 12, 2005
INVENTOR(S) : Takashi Arai et al.

It is certified that error appears in the above-identified patent and that said Letters Patent is hereby corrected as shown below:

Title page,
Please delete the exemplary drawing and substitute the following exemplary drawing below:

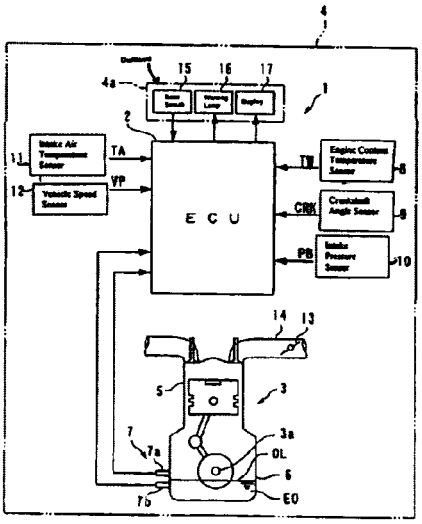

Please delete Figure 1 and 2 and substitute attached Figure 1 and 2.

Signed and Sealed this

Seventh Day of February, 2006

JON W. DUDAS
*Director of the United States Patent and Trademark Office*